US006985684B2

(12) United States Patent
Matsuo et al.

(10) Patent No.: US 6,985,684 B2
(45) Date of Patent: Jan. 10, 2006

(54) IMAGE FORMING APPARATUS HAVING PRESET DEVELOPER UNIT REPLACEMENT POSITIONS AND A LOCKING DEVICE

(75) Inventors: Yasuhiro Matsuo, Nagano-Ken (JP); Satoru Miyamoto, Nagano-Ken (JP); Minoru Kishigami, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/650,048

(22) Filed: Aug. 28, 2003

(65) Prior Publication Data

US 2004/0057751 A1 Mar. 25, 2004

(30) Foreign Application Priority Data

| | | |
|---|---|---|
| Aug. 29, 2002 | (JP) | 2002-250716 |
| Aug. 29, 2002 | (JP) | 2002-250717 |
| Aug. 29, 2002 | (JP) | 2002-250718 |
| Aug. 29, 2002 | (JP) | 2002-250719 |
| Aug. 29, 2002 | (JP) | 2002-250720 |
| Jul. 8, 2003 | (JP) | 2003-193582 |

(51) Int. Cl.
*G03G 15/01* (2006.01)

(52) U.S. Cl. ..... 399/227

(58) Field of Classification Search ..... 399/323, 399/326–328, 223, 226, 227, 228
See application file for complete search history.

(56) References Cited

U.S. PATENT DOCUMENTS

| | | | | |
|---|---|---|---|---|
| 4,030,445 A | | 6/1977 | Takenaga et al. | |
| 4,743,938 A | | 5/1988 | Ohno | |
| 5,471,292 A | * | 11/1995 | Okazawa | 399/233 |
| 5,495,327 A | | 2/1996 | Inomata | |
| 5,585,911 A | * | 12/1996 | Hattori et al. | 399/227 |

FOREIGN PATENT DOCUMENTS

JP 61-95370 5/1986

(Continued)

*Primary Examiner*—Arthur T. Grimley
*Assistant Examiner*—Ryan Gleitz
(74) *Attorney, Agent, or Firm*—Sughrue Mion, PLLC

(57) ABSTRACT

An image forming apparatus where during the image forming operation, the completion of development by one of development cartridges is followed by the rotation of a rotary for setting the next development cartridge to a development position. The rotational speed v of the rotary is increased linearly to the maximum speed vmax and, after that, is decreased linearly to stop the rotary when the next development cartridge reaches the development position. During replacement of the development cartridge, the rotary is rotated to set the development cartridge to be replaced to the replacement position. The rotational speed of the rotary is set to be a constant speed $v_1$ in a region other than a contact region where an input gear of the development side is in contact with a driving gear of the fixed side and a speed lower than the speed $v_1$ in the contact region (the minimum speed $v_2$).

8 Claims, 23 Drawing Sheets

FOREIGN PATENT DOCUMENTS

| | | | | |
|---|---|---|---|---|
| JP | 61-99169 | | | 5/1986 |
| JP | 61-105565 | | | 5/1986 |
| JP | 63-78175 | | | 8/1988 |
| JP | 4-11030 | | | 2/1992 |
| JP | 5-94086 | | | 4/1993 |
| JP | 6-250482 | | | 9/1994 |
| JP | 7-117784 | | | 12/1995 |
| JP | 09244402 | A | * | 9/1997 |
| JP | 10142886 | A | * | 5/1998 |
| JP | 3129875 | | | 11/2000 |
| JP | 2001134074 | A | * | 5/2001 |
| JP | 2003015409 | A | * | 1/2003 |

* cited by examiner

IMAGE FORMING APPARATUS HAVING PRESET DEVELOPER UNIT REPLACEMENT POSITIONS AND A LOCKING DEVICE

BACKGROUND OF THE INVENTION

The present invention relates to an image forming apparatus, such as an electrostatic copying machine and a printer, comprising a developing device of a rotary developing type which includes a plurality of development units attached to a rotary for conducting a multicolor development such as a full-color development. More particularly, the present invention relates to an image forming apparatus in which the replacement of a development unit of a cartridge style is conducted at a preset replacement position. Further, the present invention relates to an image forming apparatus comprising a locking means for locking a rotary in such a position that the respective developer carriers of a plurality of development units are selectively set to a development position relative to a latent image carrier.

Among conventional image forming apparatuses such as electrostatic copying machines and printers, various image forming apparatuses of a type comprising a developing device which conducts a multicolor development such as a full-color development by a plurality of development units attached to a rotary have been created. In such an image forming apparatus, the rotary is rotated to sequentially bring the respective development rollers of the development units to a development position so as to sequentially develop latent images for the respective colors on a photoreceptor, thereby achieving the image formation.

Among image forming apparatuses of this type, an image forming apparatus has been proposed which is provided near the outer periphery of the rotary with a development unit driving gear to which the driving force of a development unit driving motor is transmitted for rotating a developer carrier such as a development roller of one of the development units, brought in the development position, while each development unit has an input gear to be selectively meshed with the development unit driving gear. By meshing the input gear with the development unit driving gear at the development position, the developer carrier is driven by driving force of the development unit driving motor so that a latent image is developed with toner carried by the developer carrier.

It is technically difficult to replenish toner to the rotating development unit. There is an idea of achieving the replenishment of toner by employing a single component developer and replacing a development unit of a compact cartridge type at a predetermined replacement position. In this case, it is required to provide well workability enabling the easy replacement of the development unit. Therefore, it is preferable that the replacement position is set at a non-development position where there is no possibility of damaging the latent image carrier, not in the vicinity of the latent image carrier and that the direction of detaching the development unit is set to the axial direction or the radial direction.

By the way, during the rotary with the plural development units mounted thereon is rotated, the input gears of the development units collide with the driving gear which is rotatably disposed near the outer periphery of the rotary, thus generating impact on the both gears due to the collision. In the normal image forming operation, the rotation of the rotary stops when the development unit reaches the development position. Accordingly, the input gear collides with the driving gear at extremely low speed to come in mesh with the driving gear. Though the impact during the collision is therefore relatively small, it is desired to further reduce the impact to achieve the smooth meshing between the both gears.

To reduce the impact due to collision between the both gears during rotation of the rotary in the normal image forming operation, Japanese Patent Publication No. H4-11030 discloses that a driving gear is supported to a pivotal shaft fixed at a predetermined position near the orbit of an input gear toward the development position such a manner as to allow a rocking movement of the driving gear by an elastic member, thereby reducing the impact due to collision between the input gear of the rotary side and the driving gear during the normal image forming operation and thus achieving the smooth meshing between the both gears.

Japanese Patent No. 3129875 discloses the rotation of a rotary for detecting the absence or presence of the development unit, that is, the rotation of the rotary in the non-image forming operation where the normal image forming operation is not conducted.

However, Japanese Patent Publication No. H4-11030 has neither disclosed nor suggested any rotation of the rotary in the non-image forming operation, for example, the rotation of the rotary for replacing a development unit as mentioned above. Therefore, the invention disclosed in Japanese Patent Publication No. H4-11030 is useful for reducing the impact due to collision between the input gear and the driving gear in the normal image forming operation, but not always useful for reducing the impact due to collision between the input gear and the driving gear during the rotation of the rotary in the non-image forming operation.

That is, in case of replaceable development units, the rotary is required to rotate to bring a development unit to be replaced to the replacement position in non-development position as mentioned above. Accordingly, the input gear of the development unit or the input gear of other development unit must pass the position where it collides with the driving gear. According to the rotation of the rotary during the operation for replacing development unit in the non-image forming operation, the input gear and the driving gear collide with each other so as to produce impact. The impact of this case affects the driving of the rotary even though the driving gear, disposed to allow its rocking movement because of the elastic member, evades away from the input gear.

In particular, in case of replacing a plurality of development units, the rotary is subjected to imbalance due to offset load generated in a state that one or more development units are removed. In this state, the impact is further increased to affect the driving of the rotary, thus not only further affecting the driving of the rotary but also increasing the load of the rotary driving motor. As the load of the rotary driving motor is increased, in case of employing a stepping motor as the rotary driving motor, the stepping motor may be stepped out, making the reliability poor.

It is desired to reduce the time required for replacing development unit as shorter as possible to achieve rapid replacement operation. However, as the rotary is rotated at a relatively high speed, the aforementioned impact is further increased. This is also a problem.

The above problems may be caused not only during the rotation of the rotary for replacing development unit but also during, for example, the rotation of the rotary for resetting and initializing the phase of the rotary after power-on.

Japanese Patent No. 3129875 has only disclosed the rotation of the rotary in the non-image forming operation, but has neither disclosed nor suggested the impact due to the collision between the input gear and the driving gear during this rotation of the rotary, that is, not considered such problems due to the impact as mentioned above.

On the other hand, as a method of sequentially positioning the rotary at a predetermined position and locking the rotation of the rotary at the position, the simplest method is utilizing the holding force of a driving motor for rotating the rotary. However, in view of the power consumption for holding operation and the holding capacity of the driving motor, it is preferable to position the rotary by some mechanical means without resort of holding force of the driving motor. In case that a single driving motor is used for driving both the development units and the rotary, it is required to provide two power transmission control means in the corresponding driving gear trains, respectively. When the driving motor drives either of the development units or the rotary, the power transmission control means in the corresponding driving gear train is connected and the power transmission control means in the other driving gear train is isolated. That is, since the power transmission control means in the rotary driving gear train is isolated when the development unit is driven after positioning of the rotary, it is impossible to utilize the holding force of the driving motor. Therefore, another mechanical means is required for positioning the rotary. Conventionally, it has been proposed that the positioning of the rotary is mechanically achieved by engaging a lever, attached to the body of the image forming apparatus, with a part of the rotary.

The lever is disposed such that it can move between an evacuation position where it does not position the rotary and a holding position where it is engaged with the rotary to position the rotary. In this case, in case of forming a full-color image from four colors, the operation of changing color among the four colors is required for sequentially developing electrostatic latent images of four colors on a latent image carrier. Since it is preferable to shorten the time required for this operation of changing color as shorter as possible, the lever is required to rapidly move between the evacuation position and the holding position.

Accordingly, in a general conventional manner, a solenoid and a spring are used for operating the lever and are operated under consideration of the rotational time of the rotary and the energizing time of the solenoid. That is, for setting the lever to the evacuation position, the solenoid is energized to produce solenoid force, thereby rotating the lever to the evacuation position. For setting the lever to the holding position, the energization of the solenoid is cancelled and the lever is rotated to the holding position by the biasing force of a spring.

The lever shifting means is not limited to the aforementioned means employing a solenoid. The lever may be rotated by utilizing a stepping clutch or a cam driven by another moving means.

In addition, proposed in Japanese Patent Publication No. H7-117784 is an image forming apparatus of a rotary developing type employing another mechanical means for locking the rotary which is composed of a cam, attached to the rotary, and a stopping means, attached to the body of the image forming apparatus. The stopping means is always in contact with the cam to act corresponding to the rotation of the cam, thereby conducting the positioning of the rotary. In the rotary positioning means disclosed in Japanese Patent Publication No. H7-117784, the cam is formed to have a profile having a relatively sharp inclined face when the stopping means positions the rotary to the development position and a relatively gentle inclined face when the rotary rotates away from the development position.

As for the positioning means using the solenoid to operate the lever, the time from energization of the solenoid to the actual movement of a plunger of the solenoid is constant as a characteristic of a solenoid to be used. The selection of the solenoid can be made based on its characteristics according to the type of usage of the image forming apparatus.

However, since the time from the cancellation of the energization to the actual release by the plunger is not constant, it is required to set enough time for moving the lever to the holding position for the rotary from the stop of the rotary at the predetermined position. Even a case employing a shifting means for the lever other than the means using the solenoid, such as the means for shifting the lever by using a stepping clutch or a cam as mentioned above, it is relatively easy to estimate the operation time, but it is necessary to set the operation time after the stop of the rotor because the lever should be shifted to the holding position after the stop of the rotary. This operation time for shifting the lever to the holding position directly affects the operation time of changing color to make the operation time of changing color relatively longer. As a result, there is a problem that it is difficult to improve the speed of multicolor development.

In the positioning means disclosed in Japanese Patent Publication No. H7-117784, since the stopping means is always in contact with the cam, it is required to increase the contact force of the stopping means relative to the cam as the speed of the rotary for the operation of changing color is increased. This is because if the rotation of the rotary is speeded up with week contact force of the stopping means relative to the cam, the stopping means can not follow the sharp change in profile of the cam so that the stopping means may bounce and may come off the cam in the development position.

However, as the contact force of the stopping means relative to the cam is increased, the frictional force between the stopping means and the cam is increased. This frictional force may disturb the smooth rotation of the rotary. That is, the positioning means has a problem that there is a limitation on speed-up of the rotation of the rotary.

The initializing operation for detecting the position of the rotary is conducted just after power-on of the image forming apparatus. Since the rotary passes the development position without stopping at the development position during its rotation for the initializing operation, a strong rotational moment acts on the rotary driving side due to the collision of the stopping means against the cam during the stopping means passes the development position. This strong rotational moment affects the rotation of the rotary. This is a problem due to the structure that the stopping means is always in contact with the cam. Further, the direction of the reaction during the development reaction is inevitably determined by the configuration of the cam. This is a problem that the degree of design freedom of the image forming apparatus must be smaller.

SUMMARY OF THE INVENTION

It is an object of the present invention to provide an image forming apparatus in which the impact produced due to collision between an input gear of a development unit and a development unit driving gear during the rotation of a rotary in the non-image forming operation is effectively absorbed and the time required for rotation of the rotary in the non-image forming operation is reduced as shorter as possible, thus achieving the quick rotation of the rotary.

It is another object of the present invention to provide an image forming apparatus in which the speed for multi-color development is further improved by shortening the time required for positioning the rotary as shorter as possible so as to effectively shorten the time for operation of changing color.

It is still another object of the present invention to provide an image forming apparatus in which both development units and a rotary are driven by a single driving motor by controlling the transmission of driving force of the single driving motor, in which the speed for multi-color development is further improved by shortening the time required for positioning the rotary as shorter as possible so as to effectively shorten the time for operation of changing color, and the smooth rotation of the rotary is achieved.

It is further another object of the present invention to provide an image forming apparatus in which the adverse effect due to the reaction force during the development operation is reduced so as to increase the degree of design freedom of the image forming apparatus.

To achieve the aforementioned objects, the image forming apparatus of the present invention is an image forming apparatus comprising at least: a rotary, a rotary driving motor for rotating the rotary, a plurality of development units each of which is mounted to said rotary such that the development unit is replaceable at a replacement position and has a development roller for carrying developer and an input gear, a development unit driving motor for driving said development roller, a development unit driving gear which is disposed outside said rotary such that the development unit driving gear can be selectively meshed with one of said input gears and to which the driving force of said development unit driving motor is transmitted, and a control device for controlling the drive of said rotary driving motor and said development unit driving motor, wherein during the image forming operation, said development rollers of the respective development units are set at the development position relative to a photoreceptor by turns according to the rotation of said rotary and, at the development position, said input gears of the respective development units are meshed with said development unit driving gear so as to drive said development rollers with the driving force of said development unit driving motor by turns, thereby achieving multi-color development, and is characterized by further comprising a rotary driving motor control means which controls said rotary driving motor for the rotation of said rotary during the non-image forming operation such that the rotational speed of said rotary in a contact region where said input gear collides with said development unit driving gear is lower than the rotational speed of said rotary in a region other than said contact region.

As mentioned above, by the rotary driving motor control means, the rotation of the rotary during the non-image forming operation such that the rotational speed of the rotary in the contact region where the input gear collides with the development unit driving gear is set to be lower than the rotational speed of the rotary in a region other than the contact region, whereby the moving speed of the input gar in the contact region can be reduced. Therefore, when the input gear collides with the development unit driving gear during the rotation of the rotary in the non-image forming operation, the impact due to the collision can be absorbed. In this case, since the impact can be absorbed even though an impact absorbing means is not provided at the development unit driving gear side, the structure of the development unit driving gear side is simplified.

Accordingly, impact acting on a tooth of the input gear and a tooth of the development unit driving gear can be reduced, thereby preventing tips of the teeth from being damaged and thus effectively protecting the teeth. In addition, the load exerted on the driving unit driving motor can be reduced. Further, since the impact during collision between the input gear and the development unit driving gear is reduced, vibration transmitted to the development unit is also suppressed, thereby reducing the scattering of toner in the development unit due to the vibration.

In this case, since the impact during collision between the input gear and the development unit driving gear is reduced with keeping the rotational speed of the rotary on some level in the region other than the contact region, the time for necessary rotation of the rotary during the non-image forming operation can be shortened with protecting the teeth of both gears and suppressing the load of the development unit driving motor.

It is preferable that the rotational speed of the rotary in the region other than the contact region during the rotation of the rotary in the non-image forming operation is set to be lower than the maximum speed of the rotary rotating during the image forming operation.

The present invention is further characterized in that an impact absorbing means for absorbing an impact generated when said input gear collides with said development unit driving gear during the rotation of said rotary in the non-image forming operation is provided on said development unit driving gear side.

By adding the impact absorbing means provided on the development unit driving gear side, the impact during collision between the input gear and the development unit driving gear is further effectively absorbed.

The present invention is further characterized in that the rotational speed of said rotary in the region other than said contact region during the rotation of said rotary in the non-image forming operation is set to a first speed corresponding to the rotational speed of the maximum torque ($T_{max}$) of said development unit driving motor and the speed of said rotary when any one of the input gears passes said contact region during the rotation of said rotary in the non-image forming operation is set to a second speed lower than said first speed.

Since the rotational speed of the rotary in the region other than the contact region during the rotation of the rotary in the non-image forming operation is set to the first speed corresponding to the rotational speed of the maximum torque ($T_{max}$) of the development unit driving motor and the speed of the rotary when any one of the input gears passes the contact region during the rotation of the rotary in the non-image forming operation is set to the second speed lower than the first speed as mentioned above, the effective utilization of motor torque is achieved so that the necessary rotation of the rotary in the non-image forming operation can be reliably and rapidly conducted.

In addition, since the rotary driving motor is not required to have excess capacity even when the rotary driving motor is in the unbalanced state due to the offset load produced when one or more of the development units are removed from the rotary, the miniaturization of the rotary driving motor is achieved. Moreover, the vibration and noise generated when the rotary driving motor is driven can be reduced.

The present invention is further characterized in that the rotation of said rotary during said non-image forming operation is at least one of a group consisting of the rotation of said rotary for setting the development unit to be replaced at said replacement position during the operation of replacing said development unit, the rotation of said rotary for resetting and initializing the phase of said rotary after power-on, the rotation of said rotary for initializing the phase of said rotary after sudden power-down, and the rotation of said rotary for moving to the home position after the final development procedure.

Therefore, the time required for replacing development cartridge, the time required for initializing the rotary after power-on, the time required for initializing the phase of the rotary after sudden power-down, and the time required for moving to the home position after the final development procedure can be shortened. In addition, the impact during collision between the input gear and the development unit driving gear can be effectively absorbed.

The present invention also provides an image forming apparatus comprising a developing device of a rotary development type having a rotary on which a plurality of development units are mounted, and a locking means for positioning said rotary in order to selectively set said development units at a predetermined position and for locking the rotary at the predetermined position, wherein said locking means comprises a lockable position formed on said rotary side, a locking member which is movably disposed on the body of the image forming apparatus and has a locking position where the locking member is engaged with said lockable position to lock said rotary and an evacuation position where the locking member is not engaged with said lockable position, a shifting means for shifting said locking member to said evacuation position, and a biasing means for biasing said locking member to said locking position, and is characterized in that said locking member has a contact portion which can come in contact with said lockable position before the engagement with said lockable position according to the rotation of said rotary.

This structure ensures the contact of the lockable position with the contact portion of the locking member before the locking member provided on the body side of the image forming apparatus is engaged with the lockable position. Therefore, the movement of the locking member is synchronized with the rotation of the rotary so that the engagement between the locking member and the lockable portion is achieved at the same time that the rotary reaches the predetermined position. That is, since the start of the development operation can be allowed just after the stop of the rotary at the development position, the time required to obtain multi-color toner images by changing colors can be shortened, thus improving the image forming speed. The locking member is moved by the shifting means so that the engagement between the locking member and the lockable portion is cancelled.

The present invention is further characterized in that, in the driving means for said rotary, a driving pattern is set such that the rotary overruns said predetermined position when the driving means sets said rotary at the predetermined position.

By controlling the driving means of the rotary according to the driving pattern which is set such that the rotary overruns, the rotation of the rotary is ensured to overrun the predetermined position even when the rotary is subjected to offset load. Therefore, as the rotary reaches the predetermined position, the locking member and the lockable portion are engaged with each other. Accordingly, even when the rotary is subjected to offset load, the rotary is reliably positioned at the predetermined position.

The present invention is further characterized by further comprising a driving motor for driving said development unit and said rotary, and a power transmission control means for conducting the transmission and isolation of the driving force of said driving motor to at least one of said development unit and said rotary.

By the power transmission control means, the development units and the rotary can be selectively driven with the driving force of the single driving motor.

The present invention is further characterized in that said locking member further has a standby position on said locking position side and wherein said locking member is set at said standby position before said locking member is engaged with said lockable position.

Accordingly, the locking member is previously set to the standby position before the stop of the rotary. The moving amount to the locking position where the locking member positions the rotary can be reduced so that the time required for development by changing colors is shortened, thereby further improving the image forming speed.

The present invention is further characterized in that said lockable position is composed of convexities formed on the rotary, said locking member is a lock lever which is movably disposed to the body of said image forming apparatus, and that said lock lever has a concavity engageable with one of said convexities and has a contact portion with which the convexity comes in contact before engaging said concavity according to the rotation of said rotary, and side walls of said concavity are each formed in an arc of a circle of which center is equal to the rotational axis of said lock lever.

Accordingly, the convexity comes in contact with the contact portion of the lock lever before the concavity of the lock lever provided on the body of the image forming apparatus is engaged with the convexity provided on the rotary side. Therefore, the movement of the lock lever is synchronized with the rotation of the rotary so that the engagement between the convexity of the rotary side and the concavity of the lock lever is achieved at the same time that the rotary reaches the predetermined position. Since the concavity of the lock lever which is rotatably disposed on the body of the image forming apparatus is engaged with the convexity of the rotary side, the rotary can be securely held at the predetermined position by the lock lever.

Though a reaction force due to the development operation is exerted on the side wall of the concavity of the lock lever via the convexity, the lock lever is scarcely affected by the reaction force of the development operation, for example, scarcely subjected to a rotational force (rotational moment) due to the reaction force even though the reaction force acts on the side wall because the side wall of the concavity is formed in an arc of a circle of which center is equal to the rotational axis of the lock lever. Since the concavity of the lock lever does not come off the convexity due to the reaction force, the positioning of the rotary is secured. In addition, even when the development operation is suddenly stopped such as an irregular case, the positioning of the rotary is securely conducted.

Since the adverse effect due to the reaction force during the development operation is reduced, the degree of design freedom of the image forming apparatus is increased.

The present invention is further characterized in that said convexities are disposed corresponding to said development units, respectively, that said convexities are positioning convexities for development for positioning said rotary at said development position and positioning convexities for replacement for positioning said rotary at said replacement position, and that said lock lever has a concavity which can be selectively engaged with one of said convexities and has a contact portion with which the convexity comes in contact before engaging said concavity according to the rotation of said rotary.

Since the convexities are positioning convexities for development and positioning convexities for replacement, the rotary can be positioned at different positions of the development positions for the development units and the replacement positions for the development units. In the state where the rotary is set in the replacement position for the development unit, a component such as a developer carrier of the development unit to be replaced is spaced apart from the image carrier such as a photoreceptor, the image carrier may not be damaged by the development unit due to the replacement operation when the development unit is detached or attached to the rotary.

The present invention is further characterized in that the interval in the circumferential direction between said positioning convexity for development and said positioning convexity for replacement for one development unit is set to be smaller than the interval in the circumferential direction between said positioning convexity for replacement for said one development unit and the positioning convexity for development for the next development unit.

Even though the rotary is rotated at a relatively high speed for the image forming operation, enough period of time can be ensured until the convexity reaches the position where the convexity comes in contact with the contact portion of the lock lever. That is, before the convexity reaches the position where the convexity comes in contact with the contact portion of the lock lever, the contact portion of the lock lever is securely set in the contact position relative to the convexity. The increase in rotational speed of the rotary is achieved.

The present invention is further characterized in that the end of said each convexity is formed in an arc shape, that said contact portion is an inclined face with which the arc-shape end of said convexity can come in contact, wherein the start point of said inclined face is formed on an arc of a circle of which center is equal to the rotational axis of said rotary and which passes the ends of said convexities, and that, according to the rotation of said rotary, said convexity comes in contact with said inclined face and presses said inclined face before said convexity is engaged with said concavity.

That is, the arc-shaped end of the convexity provided on the rotary side comes in contact with the inclined face of the lock lever. Accordingly, disturbance produced when the end of the convexity collides with the lock lever is reduced so that the rotary is not affected by the collision and thus can smoothly continue to rotate. In addition, it can prevent the generation of noise due to the collision. In this case, since the start point of the inclined face is formed on an arc of a circle of which center is equal to the rotational axis of the rotary and which passes the ends of the convexities, the end of the convexity can smoothly move. Therefore, the disturbance can be further suppressed, thereby achieving further smooth rotation of the rotary and effectively preventing the noise due to collision.

In addition, since the end of the convexity is formed in an arc shape, the end of the convexity comes in contact with the lock lever at a point (or along a line). Accordingly, the contact friction due to the contact between the end of the convexity and the lock lever is reduced, thereby minimizing the effect on the rotary due to the contact friction. Therefore, further smooth rotation of the rotary is achieved.

The present invention is characterized in that said shifting means is a solenoid.

Since the solenoid is employed as the shifting means for moving the locking member, operation characteristic optimally corresponding to the quick movement of the lever can be obtained. Therefore, ensure and quick movement of the locking member can be achieved by the simple structure, thereby further optimally conducting the control of engagement and disengagement between the locking member and the lockable portion.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

Figure 1:
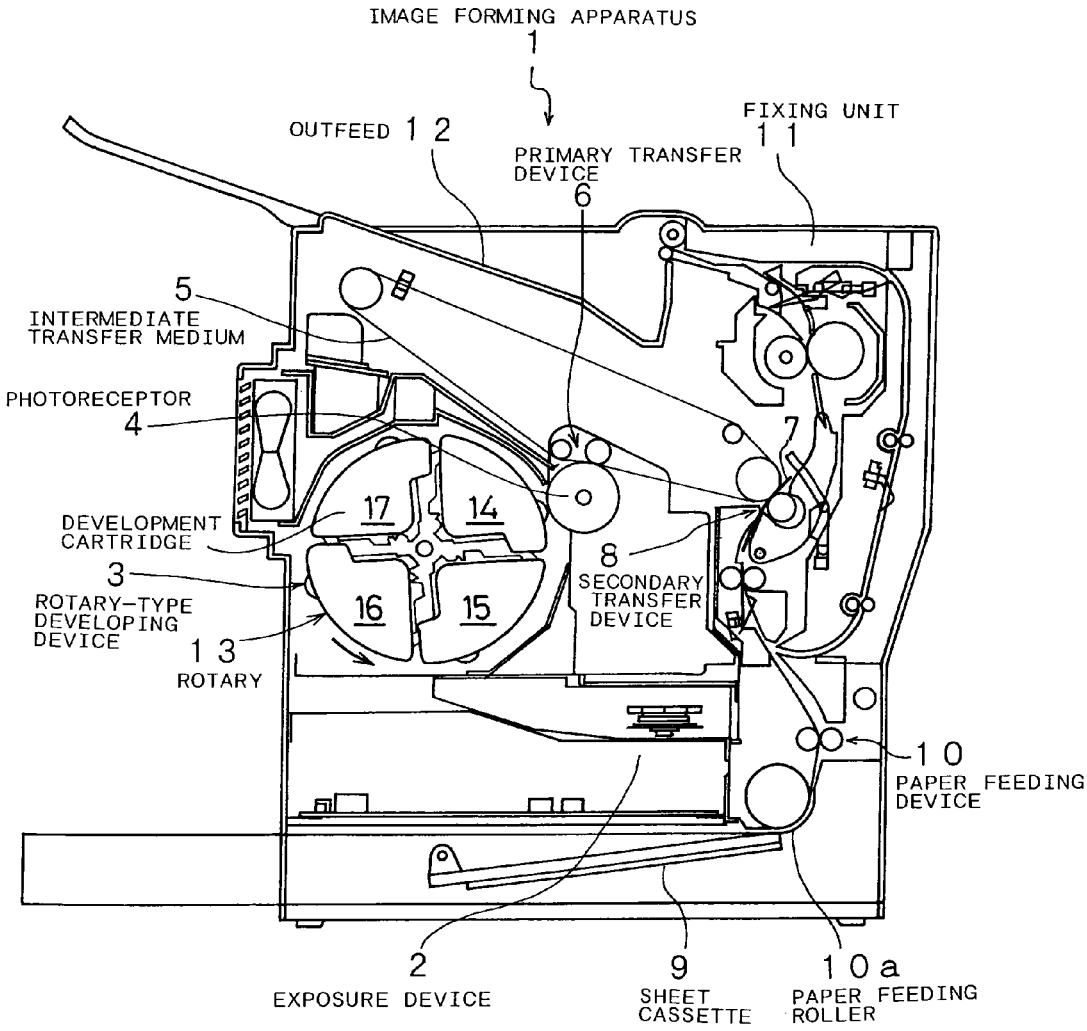
FIG. 1 is an illustration schematically showing an image forming apparatus which is common to first through third embodiments of the present invention.

Hereinafter, embodiments of the present invention will be described with reference to the attached drawings. FIG. 1 is an illustration schematically showing a first embodiment of the image forming apparatus of the present invention, FIG. 2 is an illustration schematically showing a rotary-type developing device employed in the image forming apparatus of the first embodiment, and FIG. 3 is a block diagram of the control for a rotary driving motor and a development cartridge driving motor by a CPU in the first embodiment.

As shown in FIG. 1, an image forming apparatus 1 generally comprises an exposure device 2, a rotary-type developing device 3, a photoreceptor 4 on which an electrostatic latent image is formed by exposure of the exposure device 2 and is developed with toner from the rotary-type developing device 3 so as to obtain a visible toner image, an intermediate transfer medium 5 composed of an endless transfer belt, a primary transfer device 6 for primarily transferring the toner image on the photoreceptor 4 to the intermediate transfer medium 5, a secondary transfer device 8 for secondarily transferring the toner image, primarily transferred on the intermediate transfer medium 5, to a recording medium such as a paper sheet (in the following description, the recording medium will be referred to as a paper sheet) 7, a paper feeding device 10 for feeding paper sheets 7 stacked in a sheet cassette 9 by a paper feeding roller 10*a*, a fixing unit 11 for fixing the toner image secondarily transferred on the paper sheet 7, and an outfeed tray 12 receiving the paper sheet 7 on which the given image is formed and fixed by the fixing unit 11.

Figure 2:
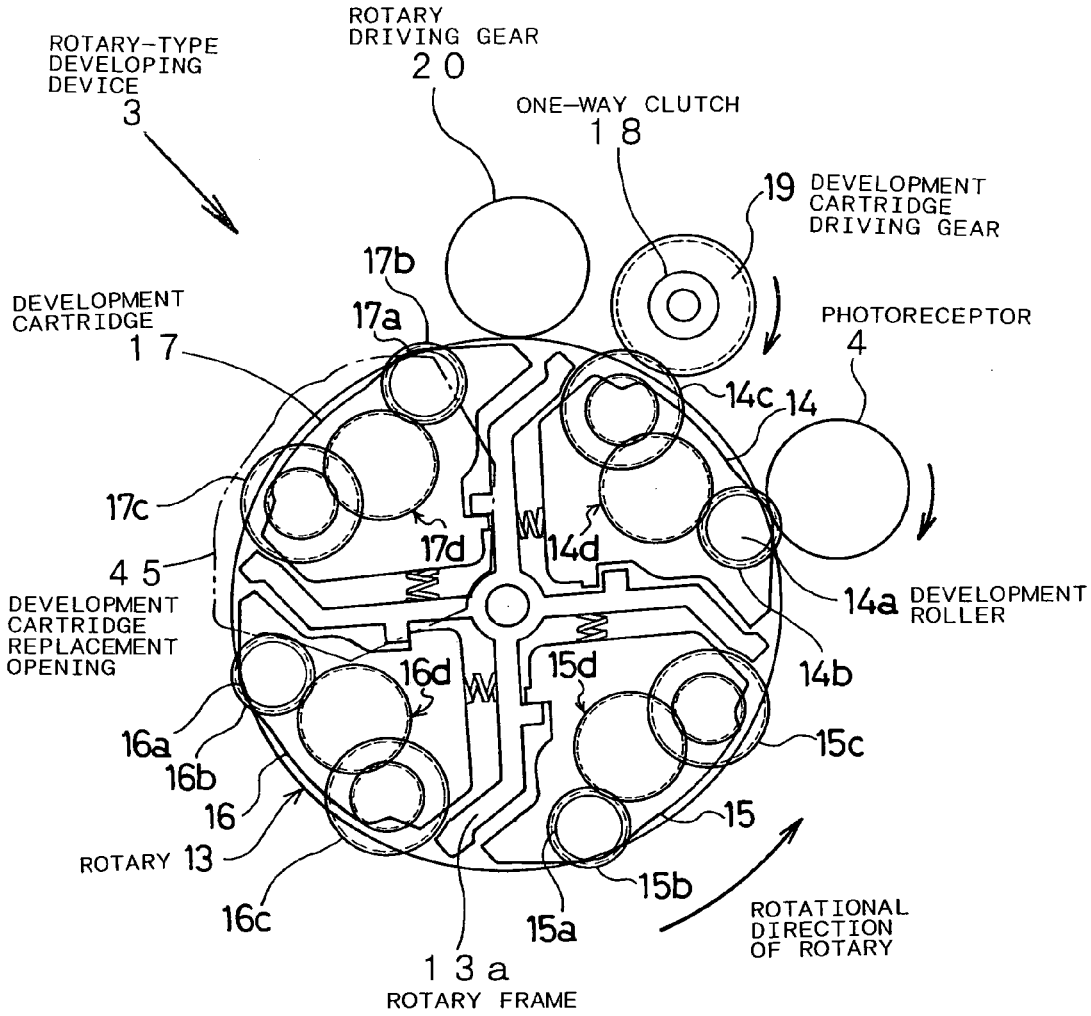
FIG. 2 is an illustration schematically showing a rotary-type developing device employed in an image forming apparatus of the first embodiment.
Figure 3:
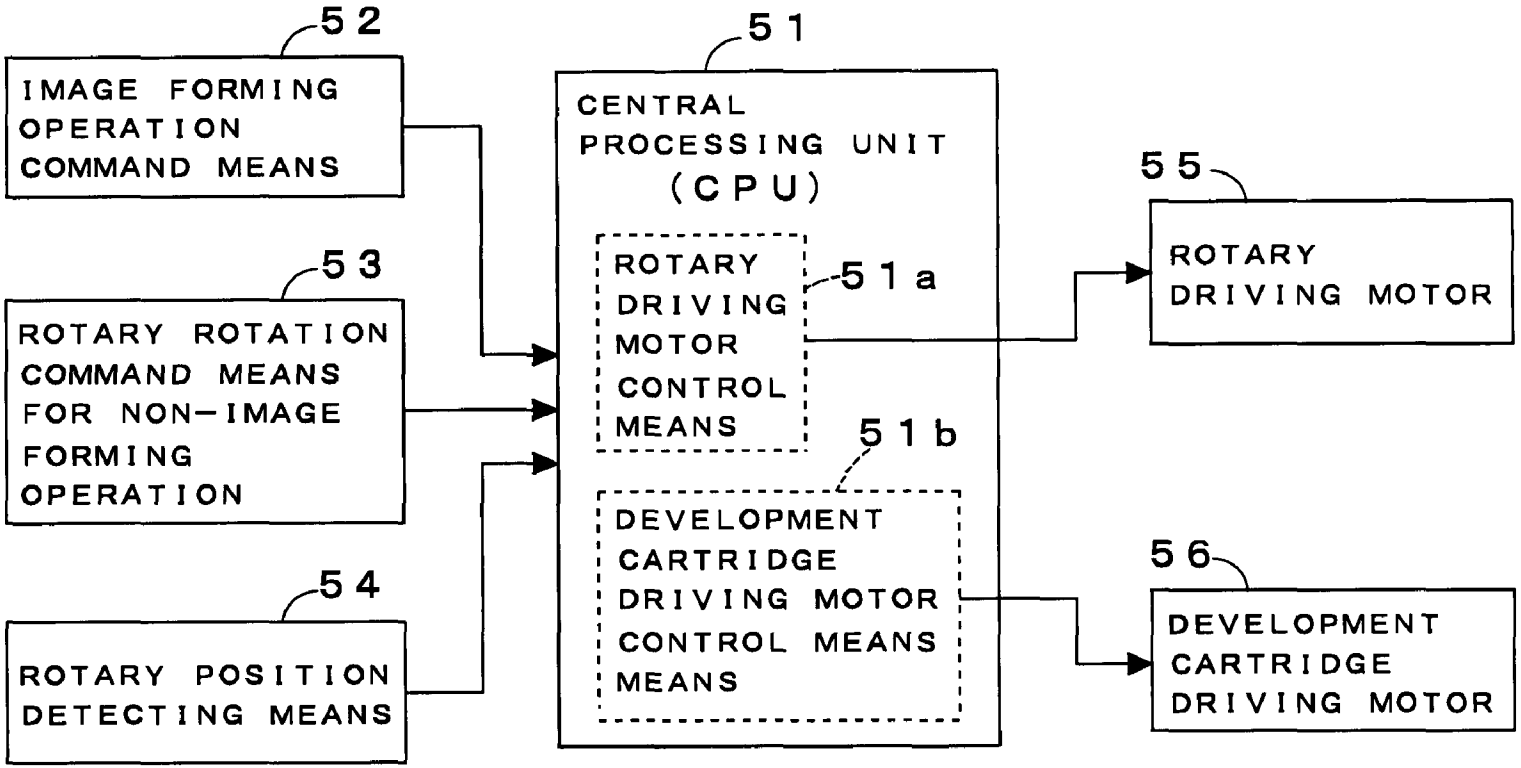
FIG. 3 is a block diagram of the control for a rotary driving motor and a development cartridge driving motor by a CPU in the first embodiment.

As shown in FIG. 2, the rotary-type developing device 3 of the first embodiment comprises a rotary 13 having a rotary frame 13*a* which is rotatably disposed, and development cartridges 14, 15, 16, 17 for respective colors of yellow (Y), magenta (M), cyan (C), and black (K) as development units supported on the rotary 13.

As shown in FIG. 2, the development cartridges 14, 15, 16, 17 are arranged along the circumferential direction of the rotary 13 in the clockwise order at even intervals and comprise development rollers 14*a*, 15*a*, 16*a*, 17*a*, development roller driving gears 14*b*, 15*b*, 16*b*, 17*b* each of which is disposed coaxially with and rotatably together with each of the development rollers 14*a*, 15*a*, 16*a*, 17*a*, input gears 14*c*, 15*c*, 16*c*, 17*c* into which driving force of the development cartridge driving motor 56 is inputted, and power transmission gear mechanisms 14*d*, 15*d*, 16*d*, 17*d* for transmitting the driving force of the motor 56, inputted in the corresponding input gears 14*c*, 15*c*, 16*c*, 17*c*, to the corresponding development roller driving gears 14*b*, 15*b*, 16*b*, 17*b* with reducing speed. It should be understood that each development cartridge 14, 15, 16, 17 comprises a toner storage portion, a toner supply means for supplying toner in the toner storage portion to each development roller 14*a*, 14*a*, 16*a*, 17*a*, and a toner regulating means for regulating the toner on the development roller 14*a*, 15*a*, 16*a*, 17*a* into a predetermined thickness to be carried to the photoreceptor 4.

A development cartridge driving gear 19, to which driving force from the development cartridge driving motor 56 is transmitted via a one-way clutch 18, is rotatably disposed near the outer periphery of the rotary 13. The development cartridge driving gear 19 can be selectively meshed with one of the input gears 14*c*, 15*c*, 16*c*, 17*c* so as to transmit the driving force to the meshed input gear. When the input gear of the development cartridge collides with the development cartridge driving gear 19, the one-way clutch 18 allows the rotation of the development cartridge driving gear 19 in the clockwise direction in the drawing so as to absorb the impact during the collision. The one-way clutch 18 composes an impact absorbing means of the image forming apparatus 1 of the first embodiment.

In addition, a rotary driving gear 24 is rotatably disposed to be meshed with a gear (shown in the drawing as the same as the outer periphery of the rotary 13, but is not limited to this configuration) which is coaxial with and rotatable together with the rotary 13, in such a manner that the driving force from the rotary driving motor 55 is transmitted to the rotary driving gear 24.

As show in FIG. 3, inputted into a CPU 51 are an image forming signal from an image forming operation command means 52 such as an image forming operation key (start key) on an operation panel of the image forming apparatus or an image forming command output means provided outside of the image forming apparatus for outputting image forming signal, a rotary rotation command for non-image forming operation from a rotary rotation command means 53 for non-image forming operation such as a rotary rotation command key for non-image forming operation on the operation panel of the image forming apparatus 1, and a rotary position detecting signal from a rotary position detecting means 54 such as a publicly known phase detector for detecting the phase of the rotary 13 or the phase of the rotary driving motor 55 or a publicly known optical position detector for detecting the rotational position of the rotary 13. The CPU 51 has a rotary driving motor control means 51*a* and a development cartridge driving motor control means 51*b* in such a manner as to output control signals from the control means 51*a* and 51*b* to the rotary driving motor 55 and the development cartridge driving motor 56, respectively.

Therefore, the rotary 13 is driven to rotate by the rotary driving motor 55, while the development cartridges 14, 15, 16, 17 are driven by the driving cartridge driving motor 56. These motors 55, 56 are controlled for their driving by the central processing unit (CPU) 51 of the image forming apparatus 1.

The rotary driving motor 55 and the development cartridge driving motor 56 can be composed of one common motor and a clutch. In the first embodiment, both the rotary driving motor 55 and the development cartridge driving motor 56 are provided.

Description will now be made as regard to the action of the image forming apparatus 1 of the first embodiment having the aforementioned structure during the image forming operation. In the state shown in FIG. 1 and FIG. 2, the development roller 14*a* of the development cartridge 14 for yellow is in contact with the photoreceptor 4, that is, the development cartridge 14 for yellow is set at the development position. When no image is developed (no image is formed), the rotary 13 is in a position other than the position shown in FIG. 1 and FIG. 2, such that all of the development rollers 14*a*, 15*a*, 16*a*, 17*a* of the development cartridges 14, 15, 16, 17 are positioned apart from the photoreceptor 4. When the image forming apparatus 1 is inoperative, movable members of the image forming apparatus 1 are stopped.

As an image forming signal is inputted into the CPU 51 from the image forming operation command means 52, the image forming apparatus 1 starts its operation for forming an image. The CPU 51 rotates the photoreceptor 4 in the clockwise direction in FIG. 1 and FIG. 2 and activates the exposure device 2. Then, the exposure device 2 exposes the photoreceptor 4 to light according to the image signal for yellow from CPU 51, thereby forming an electrostatic latent image for yellow on the photoreceptor 4. At the same time, the CPU 51 drives both the rotary driving motor 55 and the development cartridge driving motor 56 and also drives the intermediate transfer medium 5.

Then, the driving force of the development cartridge driving motor 56 is transmitted to the development cartridge driving gear 19 via the one-way clutch 18 so as to rotate the development cartridge driving gear 19. At the same time, the driving force of the rotary driving motor 55 is transmitted to the rotary driving gear 24 so as to rotate the rotary driving gear 24. By the rotation of the rotary driving gear 24, the rotary 13 is rotated in the counter clockwise direction so that the development cartridge 14 for yellow moves toward the development position shown in FIG. 1 and FIG. 2. As the development cartridge 14 reaches the development position, the CPU 51 stops the driving of the rotary driving motor 55 according to a detected signal so that the rotation of the rotary 13 is stopped.

As the development cartridge 14 for yellow is set to the development position, the input gear 14*c* is meshed with the development cartridge driving gear 19. Then, the driving force of the development cartridge driving motor 56 is inputted into the input gear 14*c* from the development cartridge driving gear 19 and is transmitted to the development roller 14*a* with a reduction in speed by the power transmission gear mechanism 14*d*, thereby rotating the development roller 14*a*. In addition, the development roller 14*a* is in contact with the photoreceptor 4, that is, in the development position.

Then, the development roller 14*a* carries a predetermined amount of yellow toner to the photoreceptor 4 so as to develop the electrostatic latent image for yellow on the photoreceptor 4, thereby forming a yellow toner image on the photoreceptor 4. Further, the yellow toner image on the photoreceptor 4 is primarily transferred to the intermediate transfer medium 5 by the primary transfer device 6.

As the transfer of the yellow toner image is finished, the CPU 51 drives the rotary driving motor 55 again so as to rotate the rotary 13 in the same direction again. Then, the development roller 14*a* is moved apart from the photoreceptor 4 and the input gear 14*c* is moved apart from the development cartridge driving gear 19, thereby stopping the operation of the development cartridge 14. That is, the rotation of the development roller 14*a* and the rotation of the input gear 14*c* are stopped. At about the time starting the rotation of the rotary 13, the exposure device 2 exposes the photoreceptor 4 to light based on the image signal for magenta from the CPU 51, thereby forming an electrostatic latent image for magenta on the photoreceptor 4.

In the same manner as the aforementioned case for yellow, as the development cartridge 15 for magenta is set at the development position, the rotation of the rotary 13 is stopped and the input gear 15*c* is meshed with the development cartridge driving gear 19. In addition, the development roller 15*a* is in contact with the photoreceptor 4, that is, in the development position. Then, the development for magenta is conducted by the development cartridge 15 for magenta and a magenta toner image developed on the photoreceptor 4 is primarily transferred to the intermediate transfer medium 5.

As the transfer of the magenta toner image is finished, the rotary 13 is rotated in the same direction again. Then, the development roller 15*a* is moved apart from the photoreceptor 4 and the input gear 15*c* is moved apart from the development cartridge driving gear 19, thereby stopping the operation of the development cartridge 15. That is, the rotation of the development roller 15*a* and the rotation of the input gear 15*c* are stopped. During this, the development cartridge driving gear 19 is kept in the rotating state.

According to the rotation of the rotary 13, a cyan toner image and a black toner image are similarly formed on the photoreceptor 4 and are primarily transferred to the intermediate transfer medium 5 one by one. Therefore, the toner images for four colors primarily transferred to the intermediate transfer medium 5 are toned to form a full-color toner image. The full-color toner image on the intermediate transfer medium 5 is transferred to a paper sheet 7 by the secondary transfer device 8. Then, the toner image transferred to the paper sheet 7 is fused by the fixing unit, thereby forming a full-color image on the paper sheet 7.

During the image forming operation of the image forming apparatus 1 of the first embodiment, as the development by one of the development cartridges 14, 15, 16, 17 is finished, the rotary 13 is rotated for setting the next development cartridge to the development position. The rotational speed control (i.e. the rotation control of the rotary driving motor) is conducted to be the constant acceleration control as shown by a solid line in FIG. 4.

That is, for setting the next development cartridge to the development position after the development of one development cartridge, the rotational speed of the rotary 13 is controlled to be increased with the constant acceleration so that the rotational speed of the rotary 13 is linearly increased. As the rotational speed of the rotary 13 becomes the maximum speed (top speed) $v_{max}$ which is previously determined, the rotational speed of the rotary 13 is controlled to be decreased with the constant acceleration so that the rotational speed of the rotary 13 is linearly decreased. When the next development cartridge reaches the development position, the rotary 13 is stopped. In this case, the top speed $v_{max}$ is set to a relatively large value in order to speed up a sequence of settings of the development cartridges 14, 15, 16, 17 to the development position to shorten the image forming period of time.

By the way, as shown in FIG. 2, in the image forming apparatus 1 of the first embodiment, the body frame of the image forming apparatus is provided at a predetermined replacement position with a development cartridge replacement opening 45. The development cartridge replacement opening 45 is formed to have a size allowing the withdrawal and insertion of the development cartridge in the axial direction of the rotary 13 (the direction perpendicular to the plane of the drawing sheet of FIG. 2).

Now, the replacement of the development cartridge will be described. As the rotary 13 is rotated during the non-image forming operation where the image forming operation is not conducted, the development cartridge to be replaced is set to the replacement position. When the development cartridge is set to the replacement position, the development roller of the development cartridge is spaced apart from the photoreceptor 4 and the input gear is spaced apart from the development cartridge driving gear 19.

In the state where the development cartridge to be replaced is set at the replacement position, the development cartridge is removed by withdrawing the development cartridge from the rotary 13 through the development cartridge replacement opening 45 in the axial direction of the rotary 13 and a new development cartridge is installed by inserting the new development cartridge into the rotary 13 through the development cartridge replacement opening 45 in the axial direction of the rotary 13.

The rotational speed control of the rotary 13 for setting the development cartridge to be replaced at the replacement position is conducted as follows. For example, as a user runs a key for the replacement of the development cartridge corresponding to the color to be replaced on the operation panel in order to replace the development cartridge, the CPU 51 only shows the state on a display of the image forming apparatus when the development cartridge to be replaced is already at the aforementioned replacement position and does not drive the rotary driving motor 55.

On the other hand, the CPU 51 drives the rotary driving motor 55 when the development cartridge to be replaced is not at the aforementioned replacement position so that the rotary 13 is controlled to rotate in the counter clockwise direction. After start of the rotation of the rotary 13, the rotational speed of the rotary 13 is controlled to be increased with the constant acceleration similarly to the aforementioned image forming operation. As the rotational speed reaches a non-image forming operation speed $v_1$ which is lower than the aforementioned top speed $v_{max}$, the rotary 13 is controlled to rotate at a constant speed of the non-image forming operation speed $v_1$ as shown by two-dot chain line in FIG. 4.

Further, when one development cartridge comes closer to the development position, that is, to a preset position just before the position where the input gear of the development cartridge collides with the development cartridge driving gear 19 during the rotation of the rotary 13, the CPU 51 controls the rotary driving motor 55 to decrease its rotational speed with a constant acceleration according to the detection signal, whereby the rotational speed of the rotary 13 is controlled to be decreased with the constant acceleration. As the input gear of the development cartridge passes the development position, the CPU 51 controls the rotary driving motor 55 to increase its rotational speed with the constant acceleration according to the detection signal, whereby the rotational speed of the rotary 13 is controlled to be increased with the constant acceleration again. As the rotational speed then reaches a non-image forming operation speed $v_1$, the rotary 13 is controlled to rotate at the constant speed of the non-image forming operation speed $v_1$. At the non-image forming operation speed $v_1$ of the rotary 13, the input gear passes the contact region relative to the development cartridge driving gear 19 and never collide with the development cartridge driving gear 19. That is, the contact region is defined as a region from the aforementioned preset position to the position of the input gear when the rotational speed of the rotary 13 becomes the non-image forming operation speed $v_1$ by the rotational speed increasing control.

After that, as the development cartridge to be replaced comes closer to the replacement position, the rotary 13 is controlled to decrease its rotational speed. As the development cartridge to be replaced reaches the replacement position, the rotary 13 is stopped.

In this manner, the rotational speed of the rotary 13 during the replacement of the development cartridge is controlled to the constant non-image forming operation speed $v_1$ which is lower than the top speed $v_{max}$ as the rotational speed of the rotary 13 during the image forming operation. In addition, when the input gear of the other development cartridge passes a region where the input gear collides with the development cartridge driving gear 19, the rotational speed of the rotary is controlled to be decrease to a speed which is further lower than the non-image forming operation speed $v_1$. According to this rotational speed control of the rotary 13, the rotary is controlled to be decelerated from the non-image forming operation speed $v_1$ when passing the region where the development roller collides with the photoreceptor 4

If the input gear of the development cartridge reaches the contact region before the rotational speed of the rotary 13 is increased to the non-image forming operation speed $v_1$, the rotation of the rotary 13 is controlled as follows.

That is, when the rotational speed of the rotary 13 in this case is higher than the minimum speed $v_2$, the rotation of the rotary 13 is controlled such that the rotational speed is decreased to the minimum speed $v_2$ and is kept at the minimum speed $v_2$ during the input gear passes the contact region. After the input gear passes the development position, the rotation of the rotary 13 is controlled to increase its rotational speed similarly to the aforementioned case. When the rotational speed reaches the non-image forming operation speed $v_1$, the speed is kept at a constant speed of this speed $v_1$. When the development cartridge to be replaced reaches the replacement position, the rotary 13 is stopped.

When the rotational speed of the rotary 13 in the aforementioned case is lower than the minimum speed $v_2$, the rotation of the rotary 13 is controlled such that the rotational speed is increased to the minimum speed $v_2$ until the input gear reaches the development position during the input gear passes the contact region. After the rotational speed becomes the minimum speed $v_2$, the rotational speed is then kept at the minimum speed $v_2$. After that, the rest of the control after the speed increasing control is conducted in the same manner as mentioned above. If the input gear reaches the development position before the rotation of the rotary 13 becomes the minimum speed $v_2$, the rest of the control after the speed increasing control is directly conducted in the same manner as mentioned above.

Figure 6:
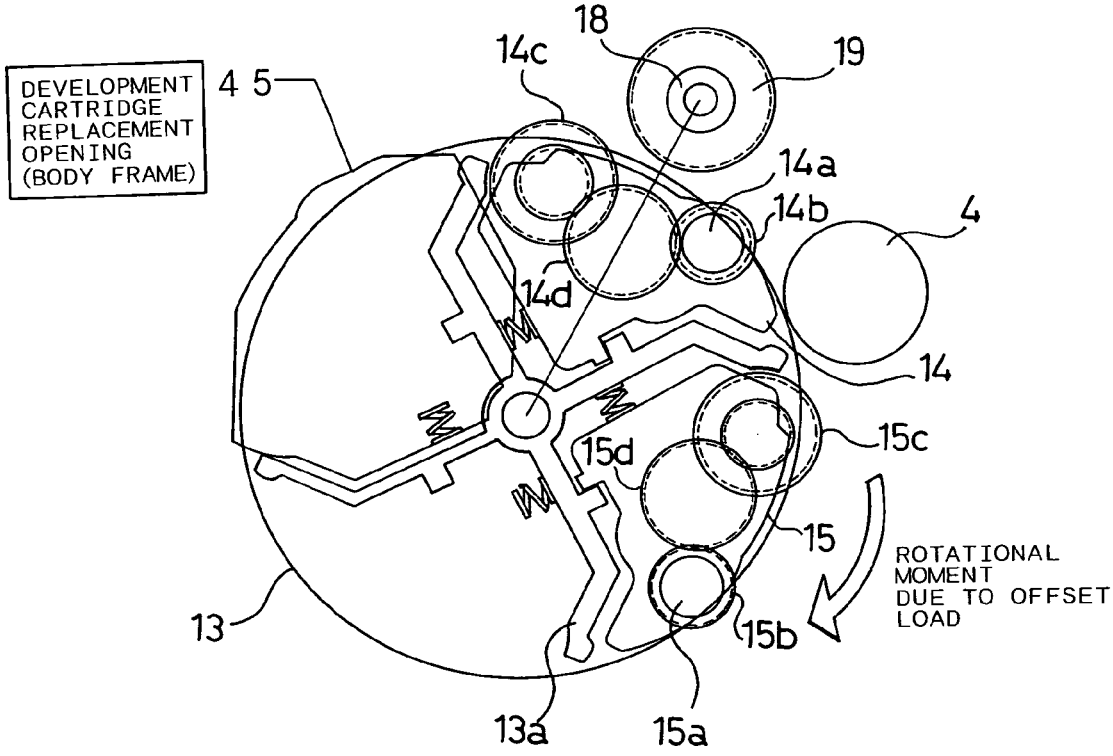
FIG. 6 is an explanatory illustration showing a state where the rotary is subjected to rotational moment due to offset load in the direction (clockwise direction) opposite to the rotational direction (counter clockwise direction)
Figure 7:
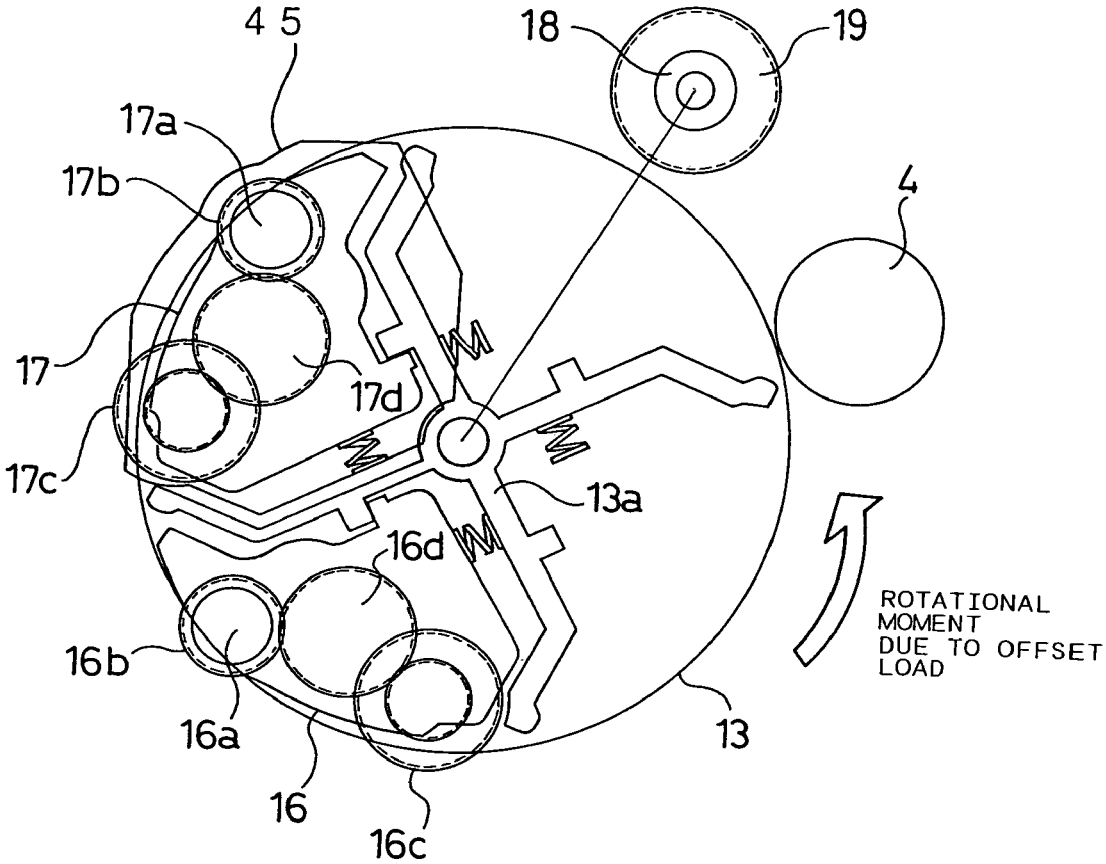
FIG. 7 is an explanatory illustration showing the state where the rotary is subjected to rotational moment due to offset load in the same direction as the rotational direction (counter clockwise direction)

It is preferable that the aforementioned non-image forming operation speed $v_1$ and the minimum speed $v_2$ at which the input gear of the development cartridge passes the contact region relative to the development cartridge driving gear 19 are determined as follows. There is a case where two of the development cartridges are removed and the rotary 13 is thus subjected to rotational moment due to offset load in the direction (clockwise direction) opposite to the rotational direction (counter clockwise direction) as shown in FIG. 6 and, on the other hand, there is a case where two of the development cartridges are removed and the rotary 13 is thus subjected to rotational moment due to offset load in the same direction as the rotational direction as shown in FIG. 7. When the rotary 13 is commanded to be rotated in the counter clockwise direction in order to replace at least one of the remaining development cartridges in either case of the above cases, it is preferable to ensure the rotation of the rotary 13 and to set the development cartridge to be replaced at the replacement position in a short time.

Figure 5:
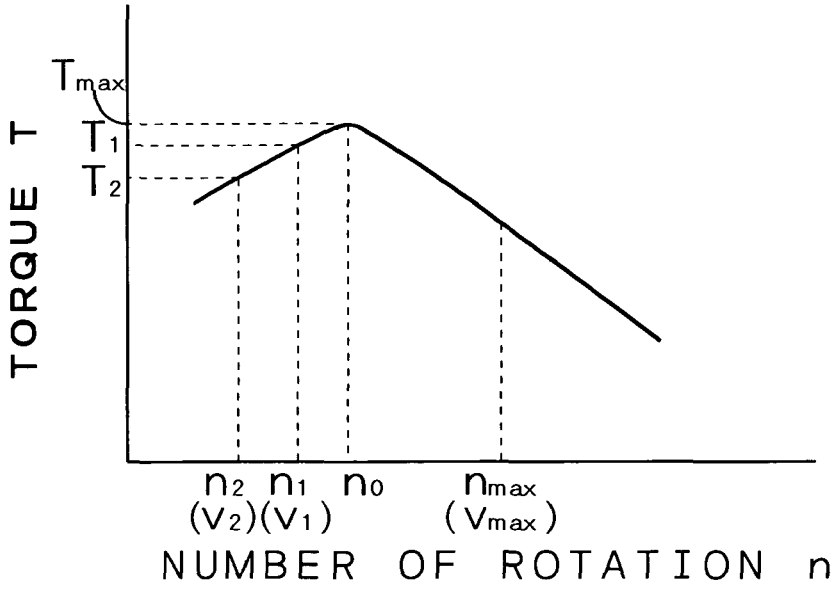
FIG. 5 is a graph showing the number of revolution (n)-torque (T) characteristics of a rotary driving motor.

To achieve these, in the image forming apparatus 1 of the first embodiment, the number of revolution (n)-torque (T) characteristics of the rotary driving motor 55 can be effectively utilized as shown in FIG. 5. That is, the non-image forming operation speed $v_1$ is set corresponding to the number of revolution $n_1$ of the motor which is smaller than the number of revolution $n_0$ of the motor at the maximum torque $T_{max}$ in the number of revolution (n)-torque (T) of the rotary driving motor 55, while the minimum speed $v_2$ is set corresponding to the number of revolution $n_2$ of the motor which is smaller than the number of revolution $n_1$ of the motor.

By effectively utilizing the motor torque with keeping the rotational speed of the rotary 13 on some level for replacing the development cartridge as mentioned above, the development cartridge can be rapidly and securely set to the replacement position.

According to the image forming apparatus 1 of the first embodiment, the rotary is set to move the input gear of the development cartridge at the constant non-image forming operation speed $v_1$, which is lower than the top speed $v_{max}$ for the image forming operation, in a region other than the contact region relative to the development cartridge driving gear 19, and to move the input gear at a speed, which is further lower than the non-image forming operation speed $v_1$, in the aforementioned contact region. Therefore, even when the input gear of the development cartridge collides with the development cartridge driving gear 19 during the rotational operation of the rotary 13 for the replacement of the development cartridge, the impact due to the collision can be effectively and efficiently absorbed.

Accordingly, impacts acting on the teeth of the input gear and the teeth of the development cartridge driving gear 19, respectively, can be reduced, thereby achieving further effective protection of these teeth and reducing the load applied on the rotary driving motor 55. In addition, since the impact during the collision between the input gear and the development cartridge driving gear 19 is absorbed, vibration transmitted to the development cartridge is inhibited, thereby reducing the scattering of toner in the development cartridge due to the vibration.

In this case, since the impact can be absorbed with keeping the rotational speed of the rotary 13 on some level for replacing the development cartridge as mentioned above, the time required for replacing the development cartridge can be shortened with protecting the teeth and reducing the load on the rotary driving motor 55.

Further, since the non-image forming operation speed $v_1$ and the minimum speed $v_2$ at which the input gear passes the contact region are set, by utilizing the number of revolution (n)-torque (T) characteristics of the rotary driving motor 55, to correspond to the first and second torques $T_1$, $T_2$ which are smaller than the maximum torque ($T_{max}$) of the rotary driving motor 55, effective utilization of motor torque can be achieved and the development cartridge to be replaced can be rapidly and securely set to the replacement position.

Further, the impact absorbing means composed of the one-way clutch 18 provided on the development cartridge driving gear 19 side is employed in addition to the above structure, whereby the impact during collision between the input gear and the development cartridge driving gear 19 can be further effectively absorbed.

Particularly, in case where rotational moment due to offset load acts on the rotary 13 in the direction opposite to the rotational direction of the rotary 13 as shown in FIG. 6, when the teeth of the input gear collide with the teeth of the development cartridge driving gear 19, moment due to reaction during this collision is added to the rotational moment due to offset load to act on the rotary 13 in the direction opposite to the rotational direction of the rotary 13. In this case, the load of the rotary driving motor 55 can be securely inhibited. Therefore, the miniaturization of the rotary driving motor 55 is achieved because the rotary driving motor 55 in the unbalanced state due to the offset load is not required to have excess capacity. In addition, the vibration and noise generated when the rotary driving motor 55 is driven can be reduced.

On the other hand, in case where two of the development cartridges are removed and rotational moment due to offset load acts on the rotary 13 in the same direction as the rotational direction as shown in FIG. 7, the impact when the tooth of the input gear collides with the tooth of the development cartridge driving gear 19 must be greater. Also in this case, the teeth can be securely protected.

Though the non-image forming operation speed $v_1$ is set to be lower than the top speed $v_{max}$ for the image forming operation in the aforementioned first embodiment, the non-image forming operation speed $v_1$ may be set to be the same as the top speed $v_{max}$. In this case, it is preferable that the absolute value of the acceleration for the speed reduction control at the contact region is set to be larger than that of the first embodiment. Also in this case, substantially the same effect as the first embodiment can be obtained. In short, it is preferable that the non-image forming operation speed $v_1$ is set to be a value lower than the top speed $v_{max}$ during the image forming operation.

Figure 4:
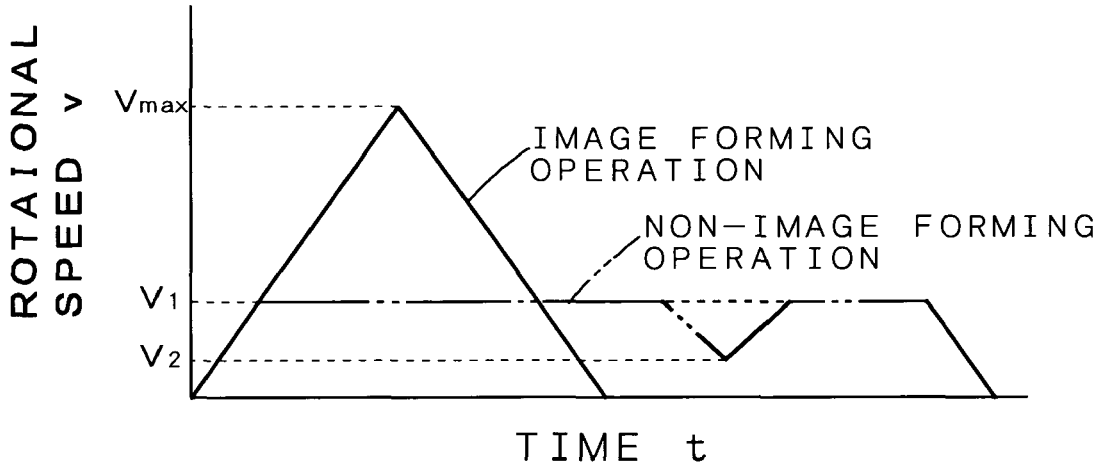
FIG. 4 is a graph showing the rotational speed curves of a rotary during the image forming operation and the non-image forming operation.

Depending on the size and weight of the development cartridge and the capacity of the rotary driving motor 55, the speed reduction control at the contact region may be omitted as shown by a chain line in FIG. 4 while the non-image forming operation speed $v_1$ is set to be a value lower than the top speed $v_{max}$. Also in this case, substantially the same effect as the first embodiment can be obtained.

Though the rotational speed control of the rotary 13 is conducted with a constant acceleration in the aforementioned first embodiment, the acceleration may vary with time.

Though the one-way clutch 18 is provided as the impact absorbing means on the development cartridge driving gear 19 side in the aforementioned first embodiment, the impact absorbing means may be composed of a spring. That is, the development cartridge driving gear 19 is biased to a meshing position at which it is meshed with the input gear, whereby the development cartridge driving gear 19 can escape from the meshing position relative to the input gear by the pressing force of the input gear when the input gear collides with the development cartridge driving gear 19.

Alternatively, a driving means such as a solenoid may be employed. In this case, the development cartridge driving gear 19 is normally set to the meshing position relative to the input gear and, if necessary, set to an evacuation position where it is not meshed with the input gear by the driving means. The aforementioned control may be adopted to an image forming apparatuses having this structure. In this case, when the rotary 13 is rotated for conducting the replacement of the development cartridge, the development cartridge driving gear 19 is set to the evacuation position by the driving means. However, if the development cartridge driving gear 19 can not be set to the evacuation position due to the driving means failure or the like so that the development cartridge driving gear 19 is still at the meshing position, the aforementioned control of the image forming apparatus 1 of the first embodiment can take effect.

That is, the present invention can be adopted to any image forming apparatus in which the input gear of the development cartridge collides with the development cartridge driving gear 19 or there is a possibility that the input gear of the development cartridge may collide with the development cartridge driving gear 19.

Further, though the non-image forming operation speed $v_1$ and the minimum speed $v_2$ are set utilizing the number of revolution (n)-torque (T) characteristics of the rotary driving motor in the above, the non-image forming operation speed $v_1$ and the minimum speed $v_2$ may be set in any other method. In case of using a stepping motor as the driving motor 55, the non-image forming operation speed $v_1$ and the minimum speed $v_2$ may be set by suitably selecting the exciting method.

Furthermore, though the contact region is defined as a region from the preset position just before the position where the input gear collides with the development cartridge driving gear 19 to the position of the input gear when the rotational speed of the rotary 13 becomes the non-image forming operation speed $v_1$ by the rotational speed increasing control in the first embodiment, the image forming apparatus of the present invention is not limited thereto. For example, the contact region is defined as a region from a first preset position before the position where the input gear collides with the development cartridge driving gear 19 to a second preset position after the position where the input gear departs apart from the development cartridge driving gear 19 by the rotational speed increasing control.

Moreover, though the rotation of the rotary 13 during the non-image forming operation is referred to as the rotation of the rotary 13 for the replacement of the development cartridge in the aforementioned first embodiment, the present invention is not limited thereto. The rotation of the rotary 13 during the non-image forming operation includes any rotation of the rotary 13 during the non-image forming operation not the image forming operation, for example, a case that, in an image forming apparatus using a motor such as a stepping motor of which phase becomes unknown when the power of the image forming apparatus is broken on a sudden, the rotary driving motor 55 of which phase is unknown is rotated for detecting the phase of the motor 55, a case that the rotary driving motor 55 is rotated for initializing the image forming apparatus 1, and a case that the rotary driving motor 55 is rotated for moving the rotary to its home position after the final development procedure.

Figure 8:
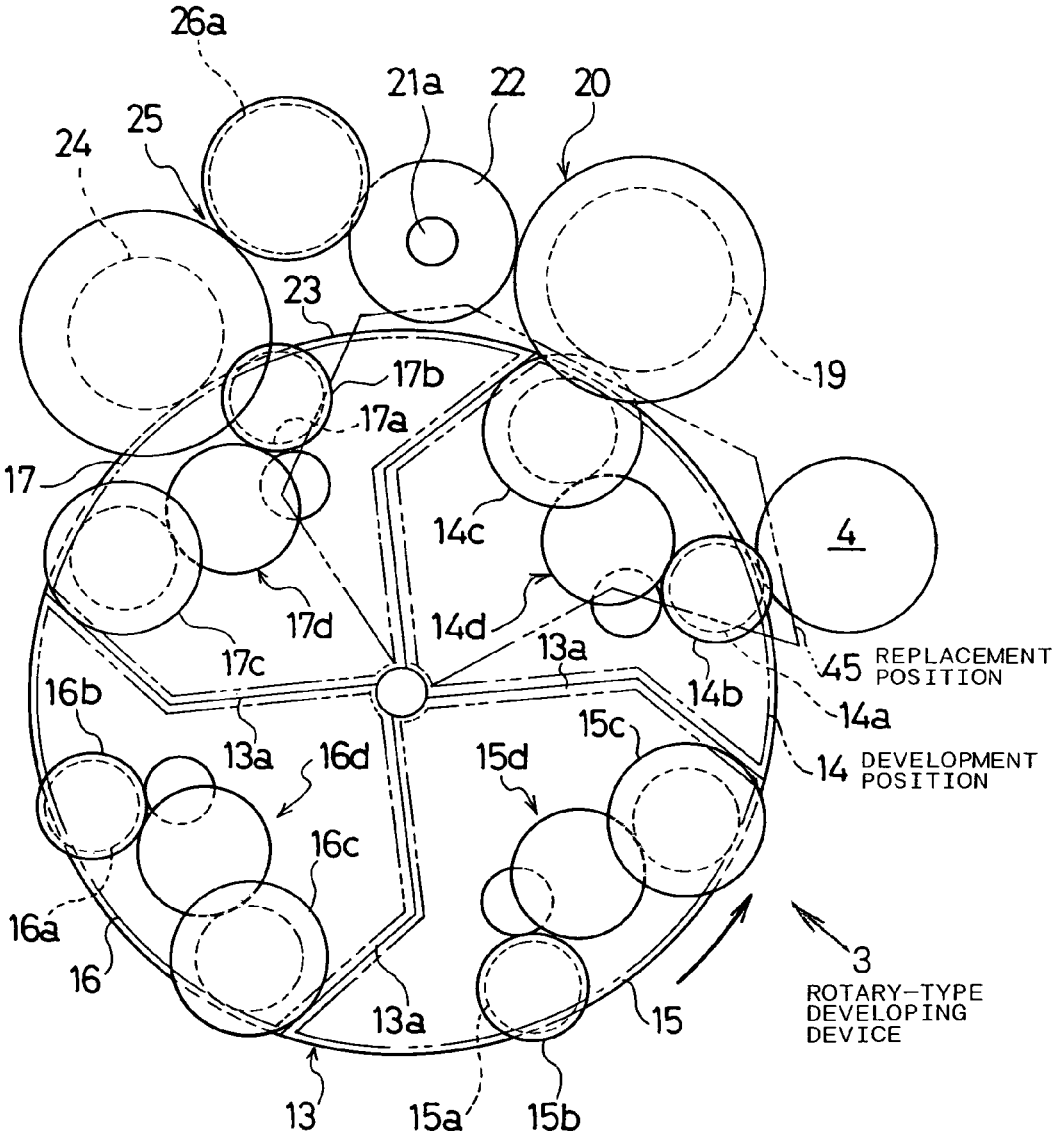
FIG. 8 is an illustration schematically showing a rotary-type developing device employed in an image forming apparatus of the second embodiment.
Figure 9:
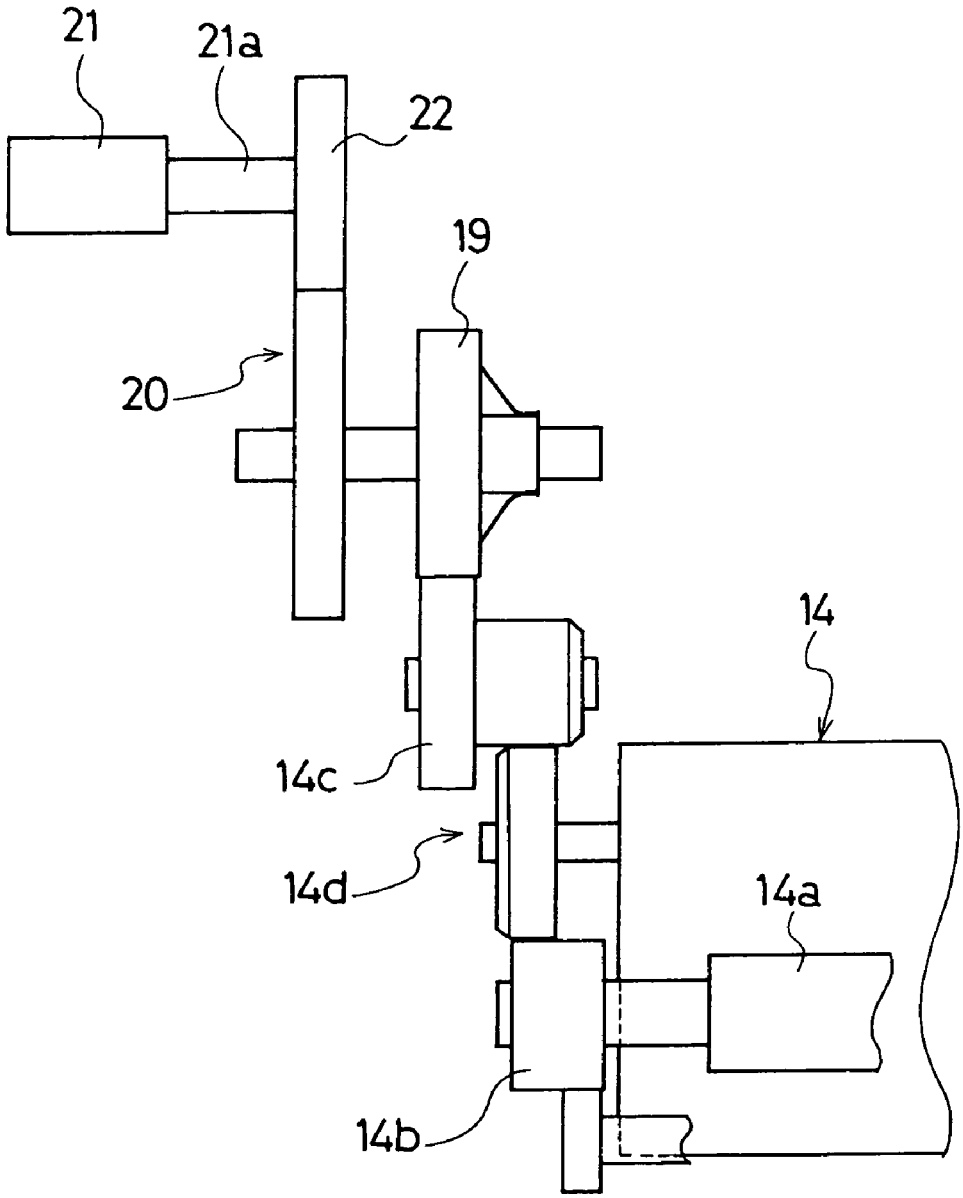
FIG. 9 is an illustration schematically showing a driving system for a development cartridge in the rotary-type developing device shown in FIG. 8.
Figure 10:
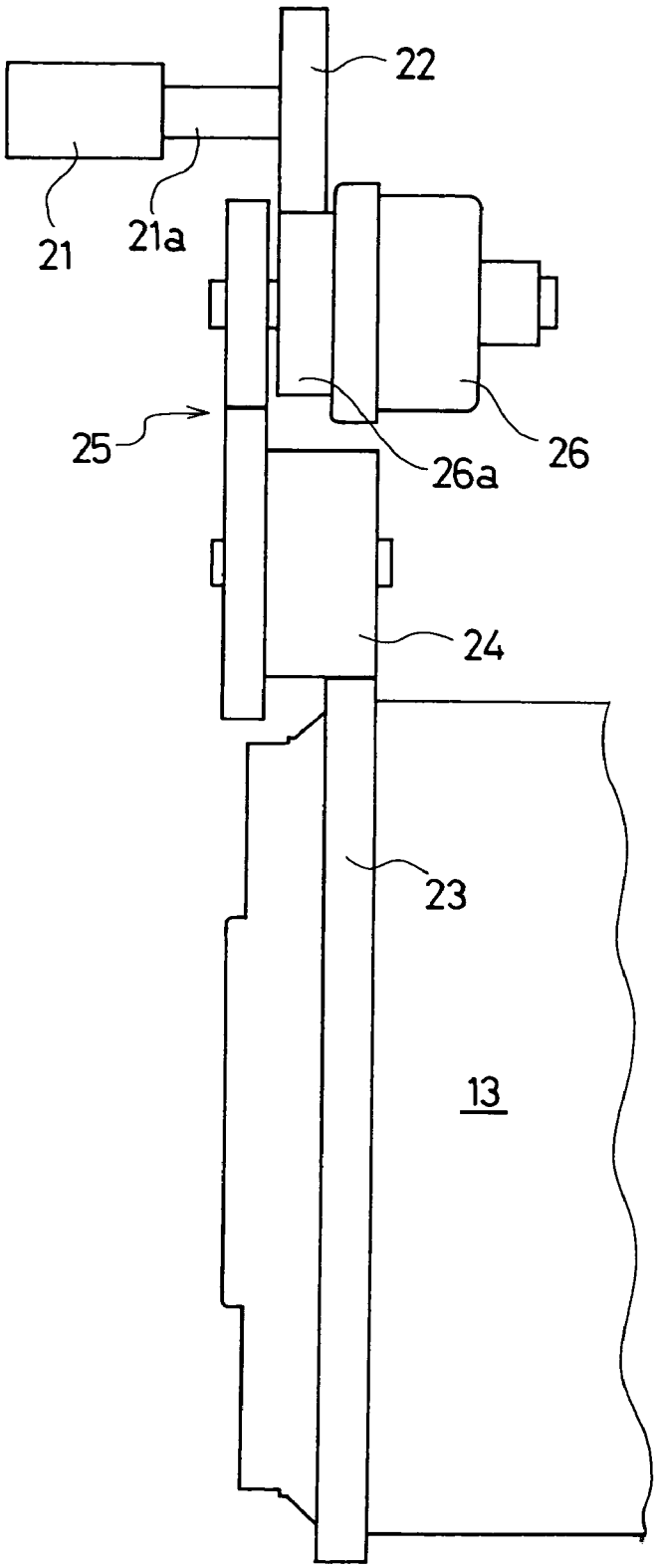
FIG. 10 is an illustration schematically showing a driving system for a rotary in the rotary-type developing device shown in FIG. 8.

FIG. 8 is an illustration schematically showing a rotary-type developing device employed in an image forming apparatus of the second embodiment, FIG. 9 is an illustration schematically showing a driving system for a development cartridge in the rotary-type developing device shown in FIG. 8, FIG. 10 is an illustration schematically showing a driving system for a rotary in the rotary-type developing device shown in FIG. 8. In the second embodiment, the same components as the components of the first embodiment are marked with the same reference numerals so that the detail description of such component will be omitted.

The basic structure of the image forming apparatus of the second embodiment is the same as that of the aforementioned first embodiment shown in FIG. 1. In the first embodiment, the rotary 13 is driven to rotate by the rotary driving motor 55 and the development cartridges 14, 15, 16, 17 are driven to rotate by the development cartridge driving motor 56. As shown in FIG. 8 and FIG. 9, in the image forming apparatus 1 of the second embodiment, however, the rotary 13 and the development cartridges 14, 15, 16, 17 are driven to rotate by a single driving motor 21.

In the image forming apparatus of the second embodiment, the development cartridge driving gear 19 is connected to a motor output gear 22 fixed to a rotational shaft 21*a* of the driving motor 21 via a power transmission gear mechanism 20 so that the driving force of the driving motor 21 is transmitted to the development cartridge driving gear 19 with a reduction in speed by the power transmission gear mechanism 20.

Further, similarly to the first embodiment, a one-way clutch 18, not shown in FIG. 8 and FIG. 9, is incorporated into the development cartridge driving gear 19. For driving the rotary 13, even when the development cartridge driving gear 19 is meshed with one of development drive input gears 14*c*, 15*c*, 16*c*, 17*c*, the one-way clutch 18 runs idle relative to the direction corresponding to the rotational direction of the rotary 13 so that the driving force is not transmitted to the development drive input gear 14*c*, 15*c*, 16*c*, 17*c*. On the other hand, for driving selectively one of the development cartridges 14, 15, 16, 17 (that is, for the development operation), the one-way clutch 18 is locked (connected) relative to the rotational direction corresponding to the developing direction so that the driving force is transmitted to the selected one of the development drive input gears 14*c*, 15*c*, 16*c*, 17*c*.

As shown in FIG. 10, a rotary driving gear 23 is disposed on one end side of the rotary 13 coaxially with the rotary 13 such that the rotary driving gear 23 can rotate together with the rotary 13. In addition, a rotary driving gear 24 to which the driving force from the driving motor 21 is transmitted is rotatably disposed to be meshed with the rotary driving gear 23. The rotary driving gear 24 is connected to the motor output gear 22 of the driving motor 21 through a power transmission gear mechanism 25 and an electromagnetic clutch 26 as the power transmission control means. In this case, an input gear 26 of the electromagnetic clutch 26 is meshed with the motor output gear 22. As the electromagnetic clutch 26 is turned on to establish the connection, the driving force of the driving motor 21 is transmitted to the rotary driving gear 24 with a reduction in speed by the power transmission gear mechanism 20.

By the way, as shown by three-dot chain line in FIG. 8, the image forming apparatus 1 of this embodiment is provided with the development cartridge replacement opening 45 which is formed at a predetermined replacement position of a body frame (not shown) thereof. The development cartridge replacement opening 45 is formed to have a size allowing the withdrawal and insertion of the development cartridge in the axial direction of the rotary 13 (the direction perpendicular to the plane of the drawing sheet of FIG. 8).

Figure 11:
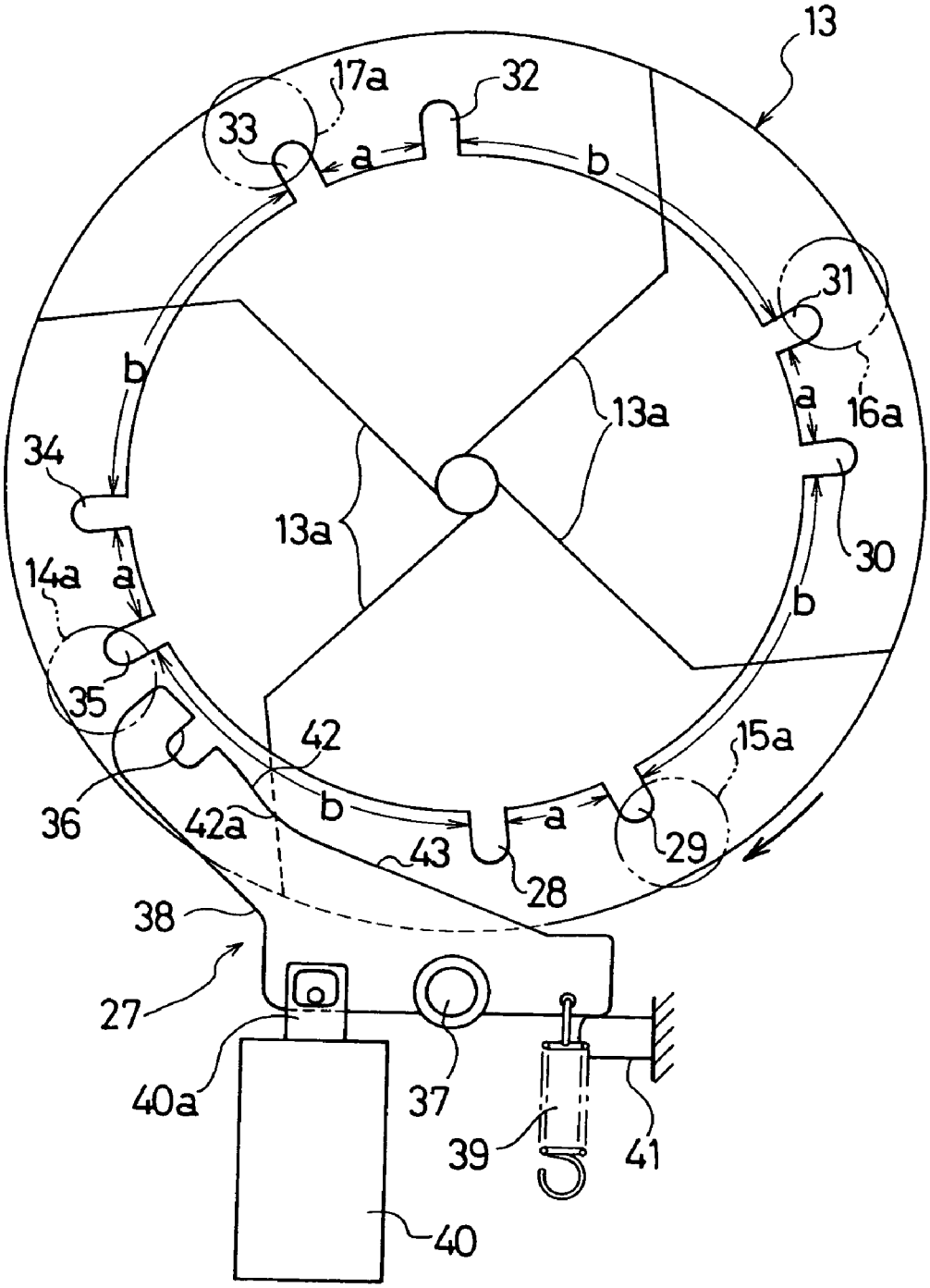
FIG. 11 is an illustration schematically showing a locking means in the rotary-type developing device shown in FIG. 8.

As shown in FIG. 11, near the other end of the rotary 13, a locking means 27 is provided for stopping the rotary 13 at a predetermined position and retaining the rotary at the stop position. The locking means 27 comprises pairs of convexities (lockable positions) 28, 29; 30, 31; 32, 33; 34, 35 fixed to the rotary frame 13*a* corresponding to the respective mounting portions for the development cartridges 14, 15, 16, 17, a lock lever 38 as a locking member being rotatable about a pivot 37 and being provided at an end with a concavity 36 which can be selectively engaged with one of these convexities 28, 29; 30, 31; 32, 33; 34, 35, a lock lever spring 39 as a biasing member which is connected to the end opposite to the end with the concavity 36 of the lock lever 38 and always biases the lock lever 38 in a direction engaging the concavity 36 with one of the convexities 28, 29; 30, 31; 32, 33; 34, 35, a solenoid (shifting means) 40 which exerts solenoid force to the lock lever 38 against the spring force of the lock lever spring 39 in a direction dragging the concavity 36 away from the one of the convexities 28, 29; 30, 31; 32, 33; 34, 35 when it is activated, and a stopper 41 which restricts the rotation of the lock lever 38 in the clockwise direction in FIG. 11 to retain the lock lever 38 at a standby position.

Figure 12:
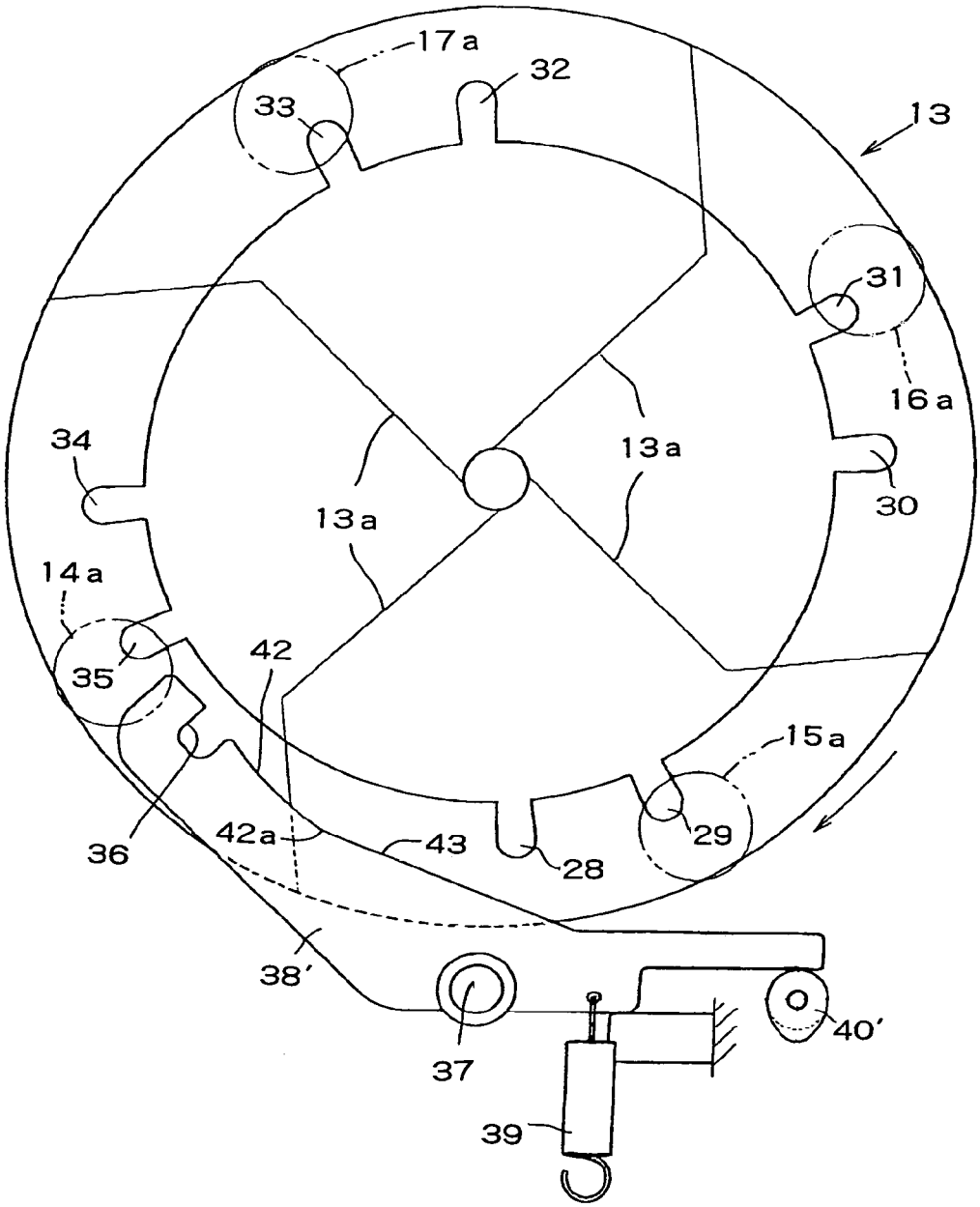
FIG. 12 is an illustration schematically showing a variation of the locking means.

The aforementioned shifting means is not limited to the solenoid and may be, for example, a cam 40'. That is, as shown in FIG. 12, the cam 40' is designed such a manner that the cam 40 always in contact with a lock lever 38' and that, for retaining the lock lever 38' at the evacuation position, a bulge of the cam surface of the cam 40' pushes up the lock lever 38' so as to move the lock lever 38' to the evacuation position. The means for driving the cam 40' may be a driving means for driving other component(s) mounted in the image forming apparatus or an independent driving means for exclusively driving the cam 40'. In this case, the rotational force of the driving means may be transmitted to the cam 40' via a stepping clutch in such a manner as to caracole the cam 40' by a full rotation of the driving means. However, for rapidly moving a lever between two positions of the standby position and the evacuation position, i.e. the shifting means is preferably a solenoid because of its suitable operational characteristics and its relatively simple structure.

Figure 13:
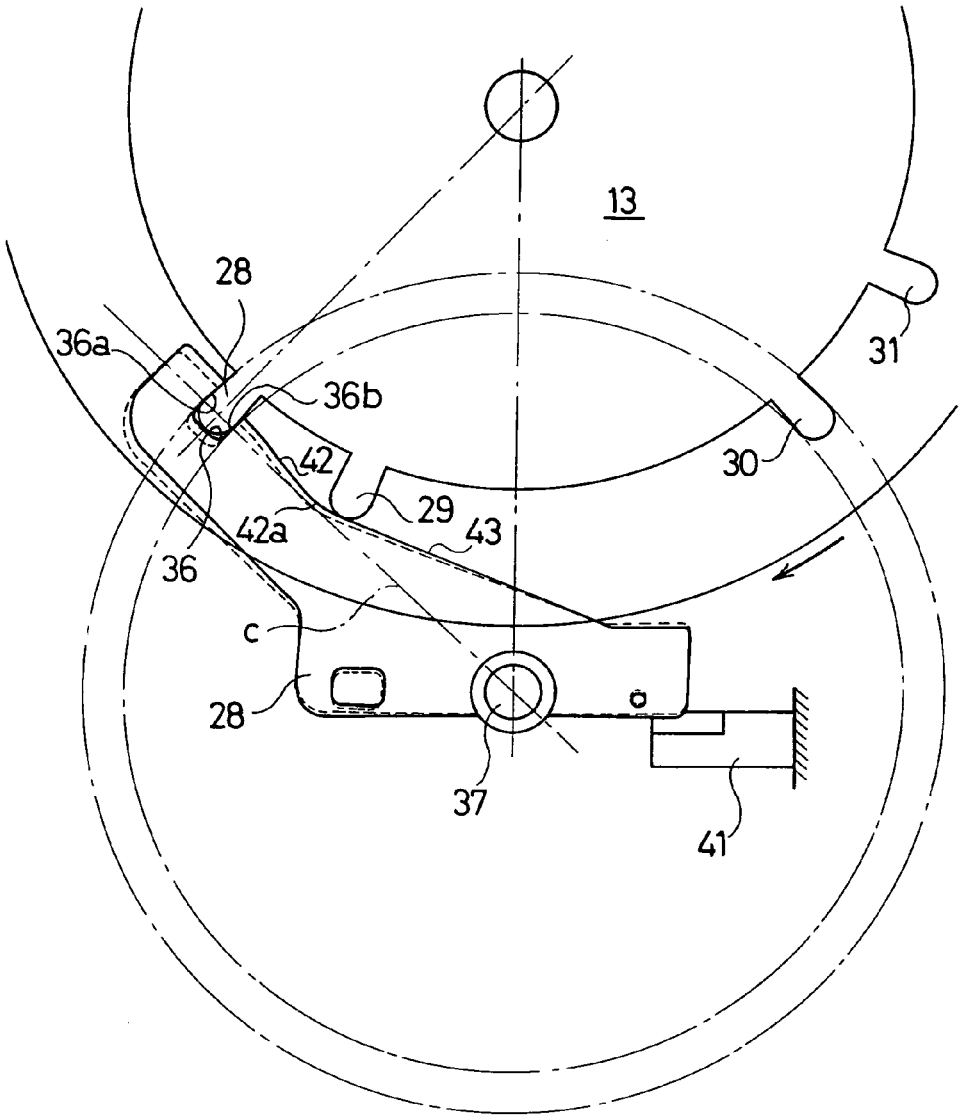
FIG. 13 is an illustration for explaining a lock lever in the locking means shown in FIG. 11.

As shown in FIG. 13, the convexities 28, 29; 30, 31; 32, 33; 34, 35 are formed to project in the radial direction of the circle of which center is equal to the rotation axis of the rotary 13 and to have arc-like ends.

As for each pair of convexities 28, 29; 30, 31; 32, 33; 34, 35 corresponding to the mounting portion for each development cartridge 14, 15, 16, 17, the convexity 28; 30; 32; 34 as one of each pair is a convexity for stopping the rotary 13 when reaching the development position of the corresponding development cartridge 14, 15, 16, 17 and retaining the rotary 13 at the stopped position, that is, a positioning convexity for development of the development cartridge, while the convexity 29; 31; 33; 35 as the other one of each pair is a convexity for stopping the rotary 13 when reaching the replacement position for the corresponding development cartridge 14, 15, 16, 17 and retaining the rotary 13 at the stopped position, that is, a positioning convexity for replacement of the development cartridge.

As shown in FIG. 11, the positioning convexities 29; 31; 33; 35 for replacement are disposed on the downstream side of the positioning convexities 28; 30; 32; 34 for development in the rotational direction of the rotary and are spaced apart from the positioning convexities 28; 30; 32; 34 for development at predetermined intervals "a" in the circumferential direction, respectively, thereby preventing the convexities 29; 31; 33; 35 from colliding with the lock lever 38 even when the lock lever 38 is set at the standby position to ensure the engagement of the concavity 36 of the lock lever 38 with the positioning convexity 28; 30; 32; 34, as will be described later.

Further, the positioning convexities 29; 31; 33; 35 for replacement corresponding to the mounting portions of the development cartridges 14, 15, 16, 17 are spaced apart from the positioning convexities 30; 32; 34; 28 for development of the development cartridges 15, 16, 17, 14 next to the development cartridges 14, 15, 16, 17 on the downstream side in the rotational direction of the rotary 13 at predetermined intervals "b" in the circumferential direction, respectively. The aforementioned interval "a" and the interval "b" are set such that the interval "a" is smaller than the interval "b" (interval "a"<interval "b").

In the image forming apparatus 1 of a rotary development type of the second embodiment, the rotary 13 is rotated at a relatively high speed during the image forming operation because it is required to rapidly set the rotary at the development positions in order to rapidly change the color in order of the development cartridges 15, 16, 17, 14, while the rotary 13 is rotated at a relatively low speed during the non-image forming operation without the image forming operation because, for example, in a case of development cartridge replacement, it is not required to set as rapidly as the image forming operation for setting the development cartridge to be replaced at the replacement position. By setting the interval "a" and the interval "b" to establish Interval "a"<Interval "b", the development cartridge 15, 16, 17, 14 can be securely set at the development position or the replacement position.

The lock lever 38 has the locking position where the concavity 36 is engaged with the concavity of the rotary 13 so as to lock the rotary, the evacuation position where the concavity 36 is not engaged with the concavity, and the standby position set near the locking position.

Figure 14:
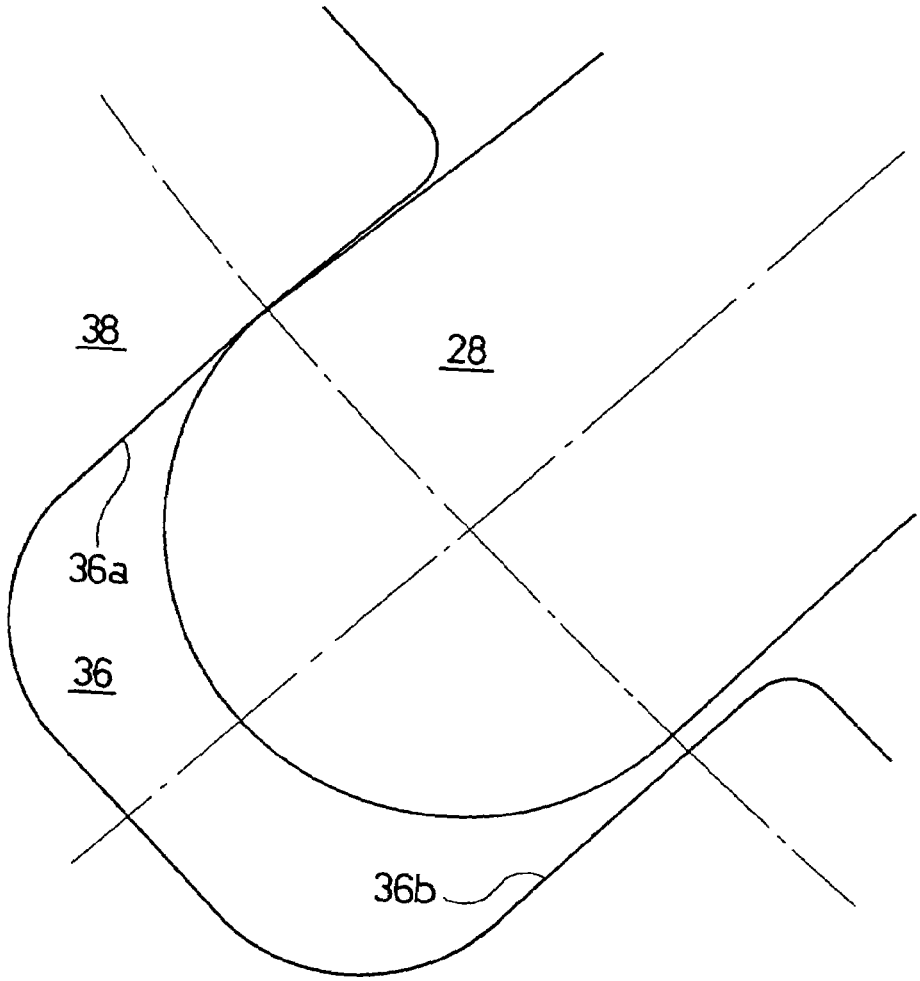
FIG. 14 is a partially enlarged view of the locking means shown in FIG. 13.

As shown in FIG. 13 and FIG. 14, both side walls 36*a*, 36*b* of the concavity 36 of the lock lever 38 are each formed to extend along an arc as a part of a circle of which center is equal to the rotation axis of the lock lever 38, i.e. the axis of the pivot 37. In addition, corners between outer surface of the lock lever 38 and the both side walls 36*a*, 36*b* of the concavity 36 are formed as rounded portions. As shown in FIG. 14, when the concavity 36 is engaged with the convexity, the side wall 36*a* and the arc face of the end of the convexity are in contact with each other at a point (along a line, exactly). During this, the reaction during the development operation of the rotary-type developing device 3 is transmitted from the end of the convexity to the side wall 36*a* and is thus received by the side wall 36*a*.

Figure 15:
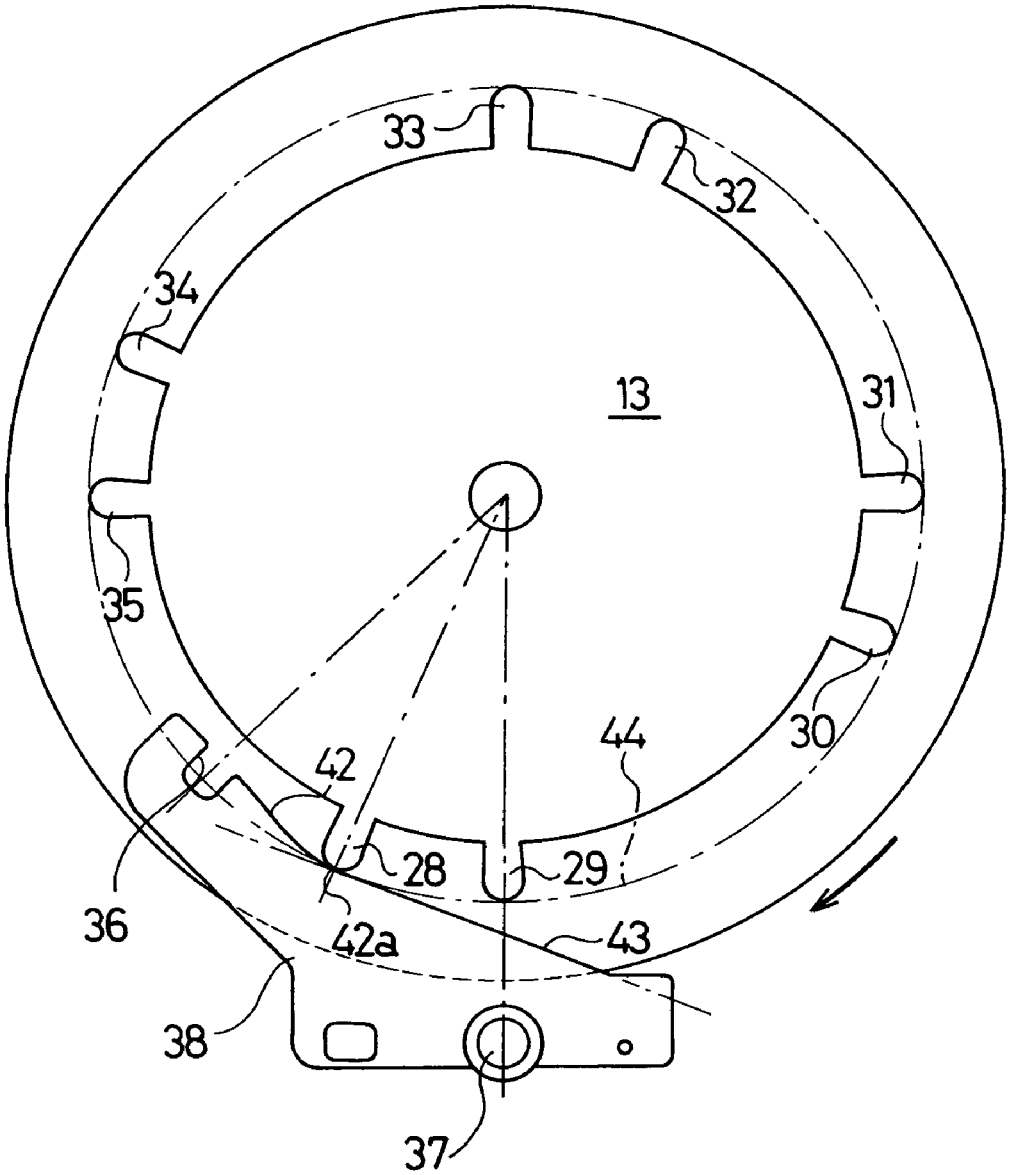
FIG. 15 is an illustration showing one scene in the operation of the locking means shown in FIG. 11 during the image forming operation.

The lock lever 38 is provided with an inclined face (contact portion) 42 which is formed in an outer periphery on a side facing the rotary 13 to incline toward the rotary 13 in a direction from the pivot 37 side toward the concavity 36 and is formed continuously from the concavity 36. In this case, the start point 42*a* of the inclined face 42 is formed on a path of rotation of the end of the convexity, that is, an arc of a circle of which center is equal to the rotation axis of the rotary 13. Concretely, as shown in FIG. 15, a contact point 42*a* between the inclined face 42 in the outer periphery of the side facing the rotary of the lock lever 38 and a linear portion 43 nearer to the pivot 37 than the inclined face 42 is formed on an arc of a circle 44 of which center is equal to the rotation axis of the rotary 13 and which has contacts with the inclined face 42 and the linear portion 43 in such a manner as to make smooth connection between the inclined face 42 and the linear portion 43 at the contact point 42*a*. Accordingly, the end of the convexity can smoothly move when the contact portion of the end of the convexity with the lock lever 38 transfers from the linear portion 43 to the inclined face 42 of the lock lever 38.

FIG. 15 shows a state that the lock lever 38 is at the standby position where the lock lever 38 is in contact with the stopper 41 shown in FIG. 11. At this point, the linear portion 43 of the lock lever 38 is identical to the tangent of the circle 44.

The pivot 37 of the lock lever 38 is positioned on a tangent c of a circle of which center is equal to the rotation axis of the rotary 13 and which passes the center of a circular arc of the end of the convexity engaged with the concavity 36 in a state that the concavity 36 is completely engaged with the convexity so that the rotary 13 is stopped and retained as shown in FIG. 13.

Hereinafter, driving patterns of the driving motor 21 and control patterns of the rotary 13 for changing color and for replacing the cartridge in the image forming apparatus of this embodiment will be described.

Figure 16:
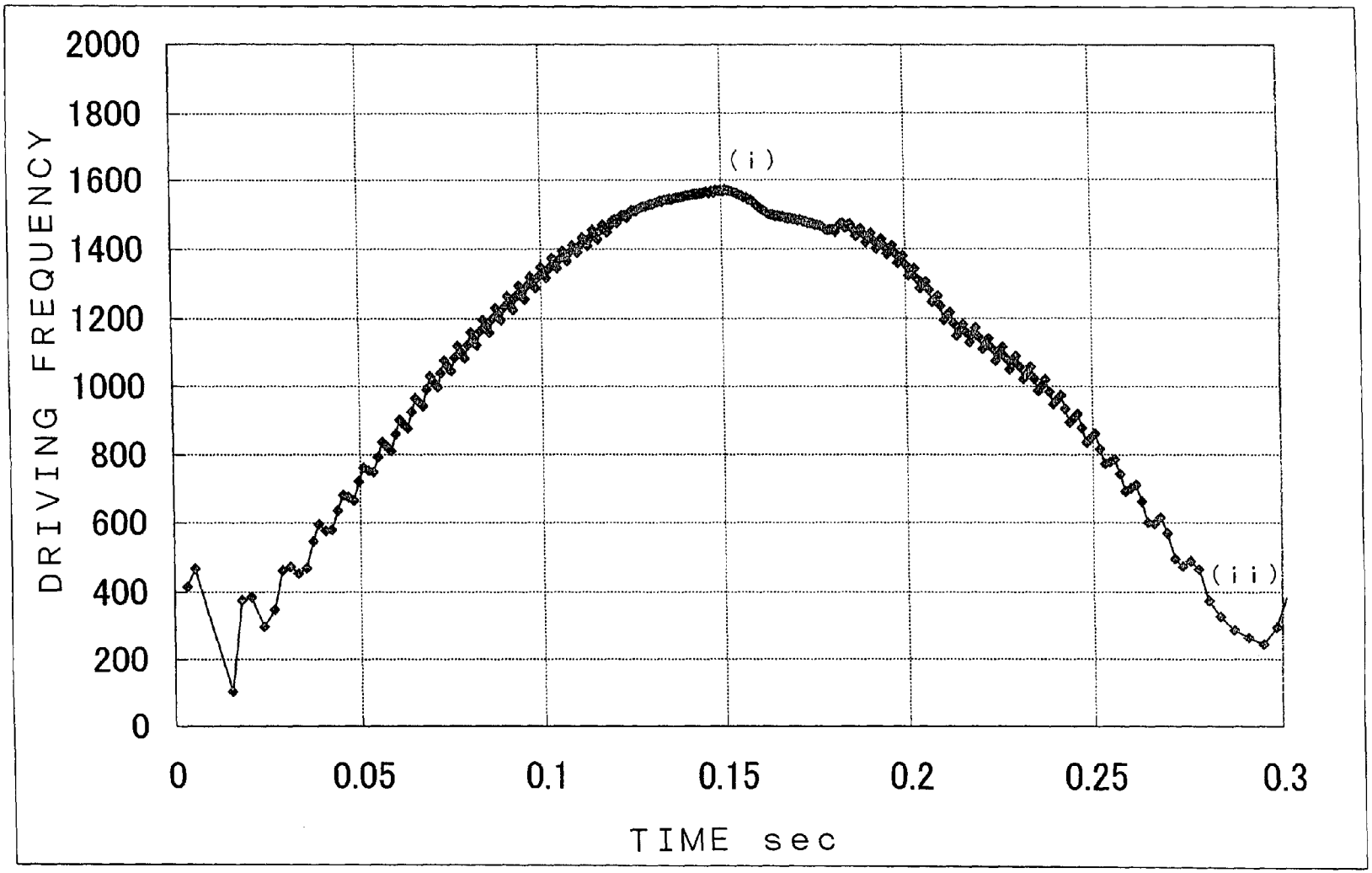
FIG. 16 is a graph showing an example of the driving pattern of the driving motor for the operation of changing development color.
Figure 17:
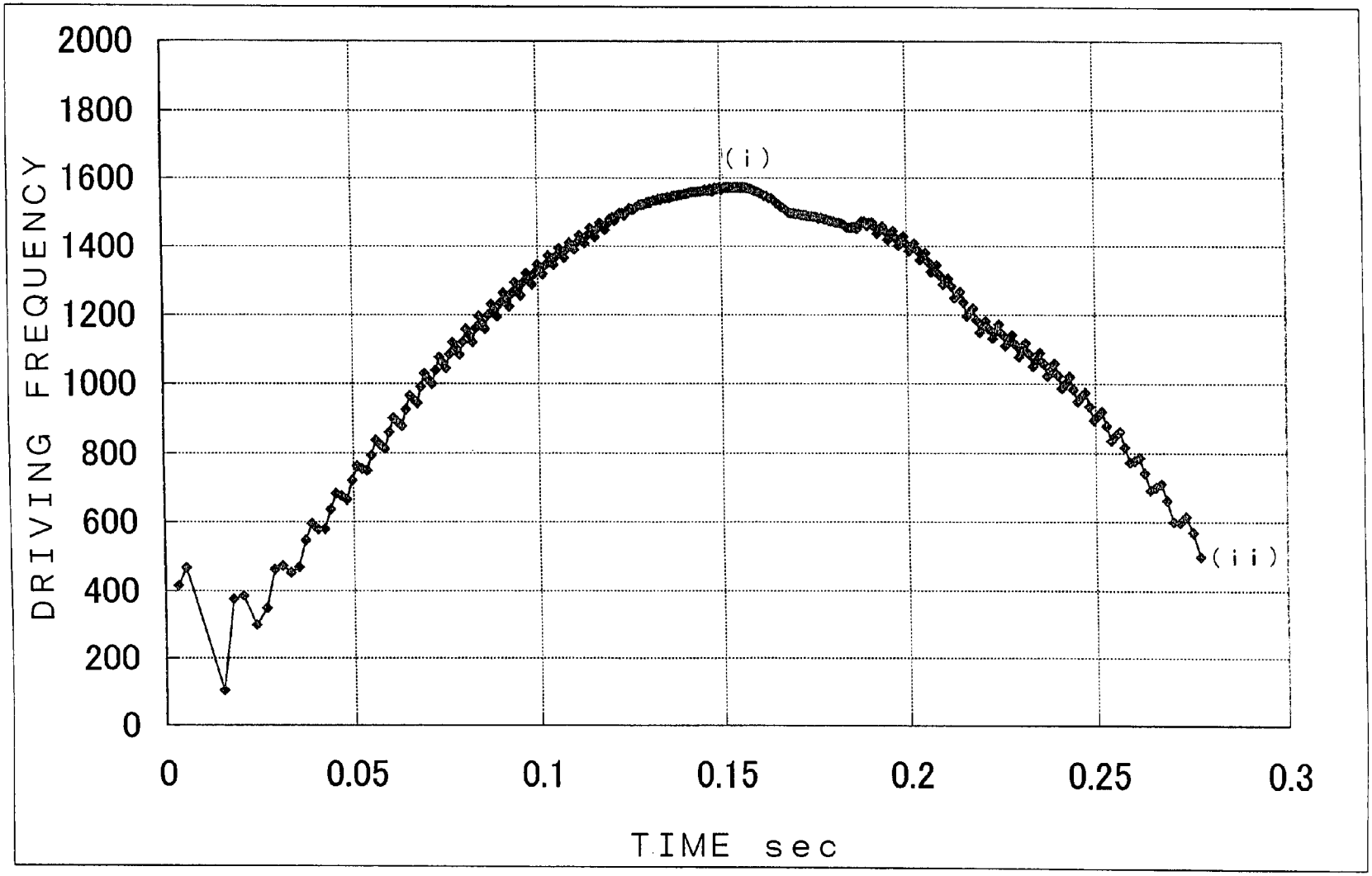
FIG. 17 is a graph showing an example of the driving pattern of the driving motor for the operation of replacing cartridge.
Figure 18:
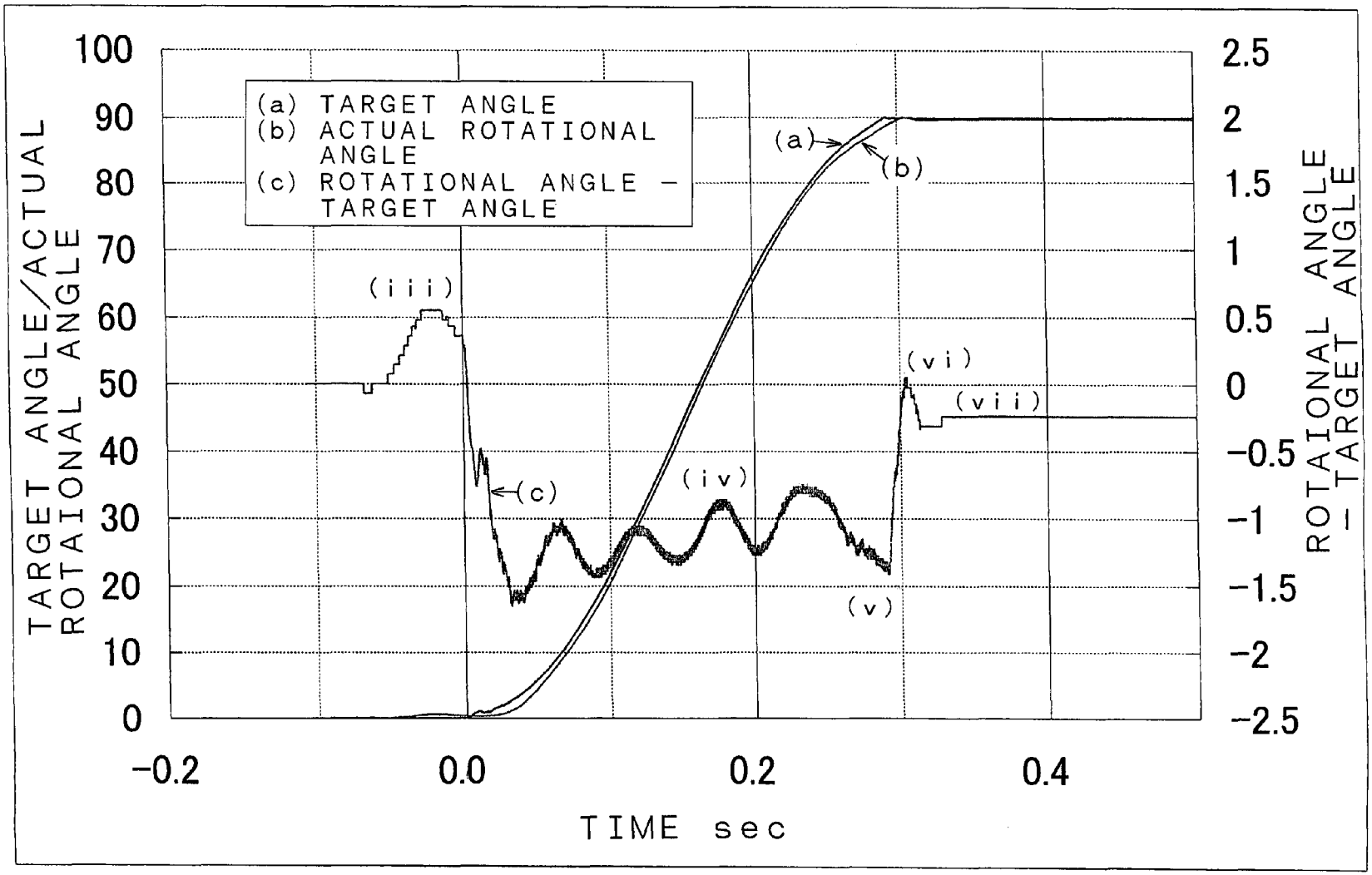
FIG. 18 is a graph showing the relation between the target angle according to the driving motor and the actual rotational angle of the rotary in the operation of replacing cartridge.

FIG. 16 is a diagram showing an example of the driving pattern of the driving motor during operation of changing development color, FIG. 17 is a diagram showing an example of the driving pattern of the driving motor during operation of detecting cartridge, and FIG. 18 is a diagram showing the relation between the target angle and the actual rotational angle during operation of detecting cartridge.

In the image forming apparatus of this embodiment, by rotating the rotary-type developing device 3 to overrun the stop position in a state that the lock lever 38 as a locking member is biased by the lock lever spring 39, the concavity 36 of the lock lever 38 is engaged with one of the convexities 28, 29; 30, 31; 32, 33; 34, 35 of the rotary frame 13*a*. In this manner, the stopping control is conducted. In this case, the overrunning amount of the rotary-type developing device 3 is set such that the overrunning amount for the stopping control for replacing the development cartridge 2 is larger than that for the stopping control for changing the development color. In addition, the driving pattern of the driving motor 21 for the operation for replacing the development cartridge is set to ensure the overrunning of the rotary 13 even in a state that the maximum offset load is exerted in the reverse rotational direction of the rotary 13, this state meeting a condition making it difficult for the rotary to overrun. The driving pattern of the driving motor 21 is set to ensure the overrunning of the rotary 13 in a state that the four color cartridges are mounted so that little offset load is applied during the operation for changing color.

That is, for ensuring the overrunning, the target angle of the driving motor 21 must be set to increase the rotational amount of the driving motor 21 to move the rotary beyond the predetermined stop position. However, if the rotational amount is increased simply, there is a possibility of deviation because the driving motor 21 continues to rotate even after the engagement of the lock lever at the stop position.

Therefore, as a measure for ensuring the overrunning in the image forming apparatus 1 of this embodiment, an acceleration in the decelerating direction (i.e. deceleration) is drastically applied to the rotary 13 to overcome the rotational force due to the offset load when positioning the rotary after driving the rotary.

In this case, in view of mechanical strength of the apparatus and the noise, it is preferable that the rotary 13 is driven calmly at a lowest possible speed for the initializing operation and the cartridge replacement operation, because there is no limitation in operation speed for these operations. However, when the rotary 13 is driven at the low speed, the rotational speed of the rotary 13 is not increased so that only little rotational inertia is produced.

In the image forming apparatus 1 of the second embodiment, the rotary 13 is rotated at a constant speed until reaching a predetermined stop position and the driving speed of the motor 21 is significantly zeroed, not slowly reduced, at the moment it reaches the stop position. At this moment, in theory, infinitely large negative acceleration is applied to the rotary 13 so that inertial force sufficiently overcoming the offset load of the rotary 13 is generated, whereby the rotary 13 tends to overrun the predetermined stop position because of backlash of the driving gear train.

In the cartridge detecting operation just after a new cartridge is mounted during the cartridge replacement operation, it is desired to agitate toner. For this, it is preferable to rotate the rotary 13 at a high speed. However, the addition of an exclusive driving pattern (sequence) for agitating toner makes the software production complex. By diverting the driving pattern for changing development color as the driving pattern for agitating toner, the number of man-hour for producing the software can be reduced. However, since the operation for changing development color is based on the assumption that all of the cartridges for the respective colors are mounted, the driving pattern for changing development color is not made for applying sufficient inertia when the rotary is stopped. The operation for replacing cartridge has a possibility that, depending on the presence or absence of cartridges, a strong offset load may be applied. In this embodiment, the driving pattern for changing development color is diverted with a slight change for intensifying the final end of the deceleration pattern in order to apply enough inertia to the rotary 13 when the rotary is stopped.

For example, in a driving mechanism in which when the pulse value is 300, the motor step is 1.8 degree/p, and reduction ratio is 6, the rotational angle of the driving motor 21 becomes 540 degree and the rotational angle of the rotary becomes 90 degrees (the rotational angle of a single developing device among four color developing devices), the driving mechanism is accelerated from a driving frequency around 200 to the highest driving frequency (i) in the order of 1600 during the normal operation for changing development color, taking 0.15 sec of time as shown in FIG. 16 and, reversely, is decelerated from the highest frequency to a driving frequency about 300, taking substantially the same period of time as the aforementioned period of time so that the driving pattern having an angle shape and a triangular shape is employed. Since this driving pattern is based on the assumption that the cartridges of four colors are mounted, the driving motor 21 is stopped while being accelerated at a final position to minimize the overrunning amount in consideration of the load on the driving motor 21.

In this case, however, as an offset load of the rotary 13 is increased, the rotary 13 is stopped with error in stopping angle of the rotary 13 within a range of backlash of the driving gear train of the rotary. That is, the driving motor 21 is controlled to rotate at an angle of 90 degree as the target angle. Accordingly, the rotary 13 is rotate in a range of (90±E') degrees, wherein E' is an error in stop position between the actual stop position of the rotary 13 and the predetermined stop position of the rotary 13 when it is rotated at an angle of 90 degree and is smaller than E (E'<E) as the maximum error when the rotary 13 is rotated at an angle of 90 degree.

On the other hand, the operation of replacing cartridge employs a driving pattern in which the driving mechanism is accelerated to the maximum speed (i), in the same manner as the normal operation of changing development color, as shown in FIG. 17. When the driving mechanism is at the maximum speed (i), a predetermined pulse (10 pulse) is applied, the total pulse remains unchanged, and the predetermined pulse (10 pulse) added at the highest speed (i) is eliminated at the final position (ii). In this driving pattern, the total pulse remains unchanged and the rotational angle also remains unchanged. However, the predetermined pulse (10 pulse) is added so as to shorten the intervals of pulses and shorten the total rotational time. In this case, load is exerted on the driving motor 21. However, there is no strength-wise problem because the frequency of replacing cartridges is smaller than the frequency of changing development colors.

According to this driving pattern, the state when the maximum offset load is exerted on the rotary 13 in the reverse direction meets a condition making it difficult for the rotary to overrun when the driving motor 21 is stopped. In this case, as shown in FIG. 18, the lock is released at 0.075 sec before the start of the drive so that the motor rotates by itself (iii). According to the start of the drive, the motor rotates so that the actual rotational angle lags behind the target angle by 1-1.5 degree (iv). When the target angle becomes 90 degree, the drive is stopped so that the motor starts to overrun because of its inertia (v). As the lock is engaged (vi), the motor shifts in a range allowed by the backlash of the lock and is stopped (vii). Thus, the motor 21 is turned off.

Hereinafter, description will now be made as regard to the action during the image forming operation of the image forming apparatus 1 of the second embodiment having the aforementioned structure. The state shown in FIG. 1 and FIG. 8 is a state that the development roller 14*a* of the development cartridge 14 for yellow is in contact with the photoreceptor 4, i.e. that the development cartridge 14 for yellow is set to the development position. On the other hand, during the non-development (non-image forming operation), the rotary 13 is at the home position shown in FIG. 11 and all of the development rollers 14*a*, 15*a*, 16*a*, 17*a* of the development cartridges 14, 15, 16, 17 are retained apart from the photoreceptor 4.

When the image forming apparatus 1 is inactive, the movable members of the image forming apparatus 1 stop. The solenoid 40 is not excited and is thus inactive, the lock lever 38 is set at the standby position where it is in contact with the stopper 41 shown in FIG. 11 by the biasing force of the lock lever spring 39. Further, the driving motor 21 of the rotary 13 is controlled for its drive according to the driving pattern as shown in FIG. 16 for changing color and according to the driving pattern as shown in FIG. 17 for replacing cartridge.

As an image forming signal is inputted from the image forming operation command means 22 into the CPU 51 of the image forming apparatus 1, the operation of the image forming apparatus 1 for forming an image is started so that the CPU 51 is driven to rotate the photoreceptor 4 in the clockwise direction in FIG. 1 and FIG. 8 and the exposure device 2 is activated. Then, the exposure device 2 exposes the photoreceptor 4 to light according to the image signal for yellow from the CPU 51, thereby forming an electrostatic latent image for yellow on the photoreceptor 4. At the same time, the CPU 51 turns on the electromagnetic clutch 26 to establish the connection, and drives the driving motor 21 and also drives the intermediate transfer medium 5.

Then, the driving force of the driving motor 21 is transmitted to the development cartridge driving gear 19 via the motor output gear 22 and the power transmission gear mechanism 20 with a reduction in speed, whereby the development cartridge driving gear 19 is rotated. At the same time, the driving force of the driving motor 21 transmitted to the rotary driving gear 23 via the motor output gear 22, the electromagnetic clutch 26, the power transmission gear mechanism 25, and the rotary driving gear 24, whereby the rotary 13 is rotated in the counterclockwise direction in FIG. 1 and FIG. 8 or in the clockwise direction in FIG. 11. Then, the convexity 28 is moved in the clockwise direction in FIG. 11.

Since the development cartridge driving gear 19 is provided with a one-way clutch, even when the development cartridge driving gear 19 is meshed with any one of the development drive input gears 14*c*, 15*c*, 16*c*, 17*c*, the driving force of the driving motor 21 is not transmitted to the development drive input gear meshed with the development cartridge driving gear 19 because the one-way clutch runs idle relative to the rotational direction of the rotary 13.

Figure 19:
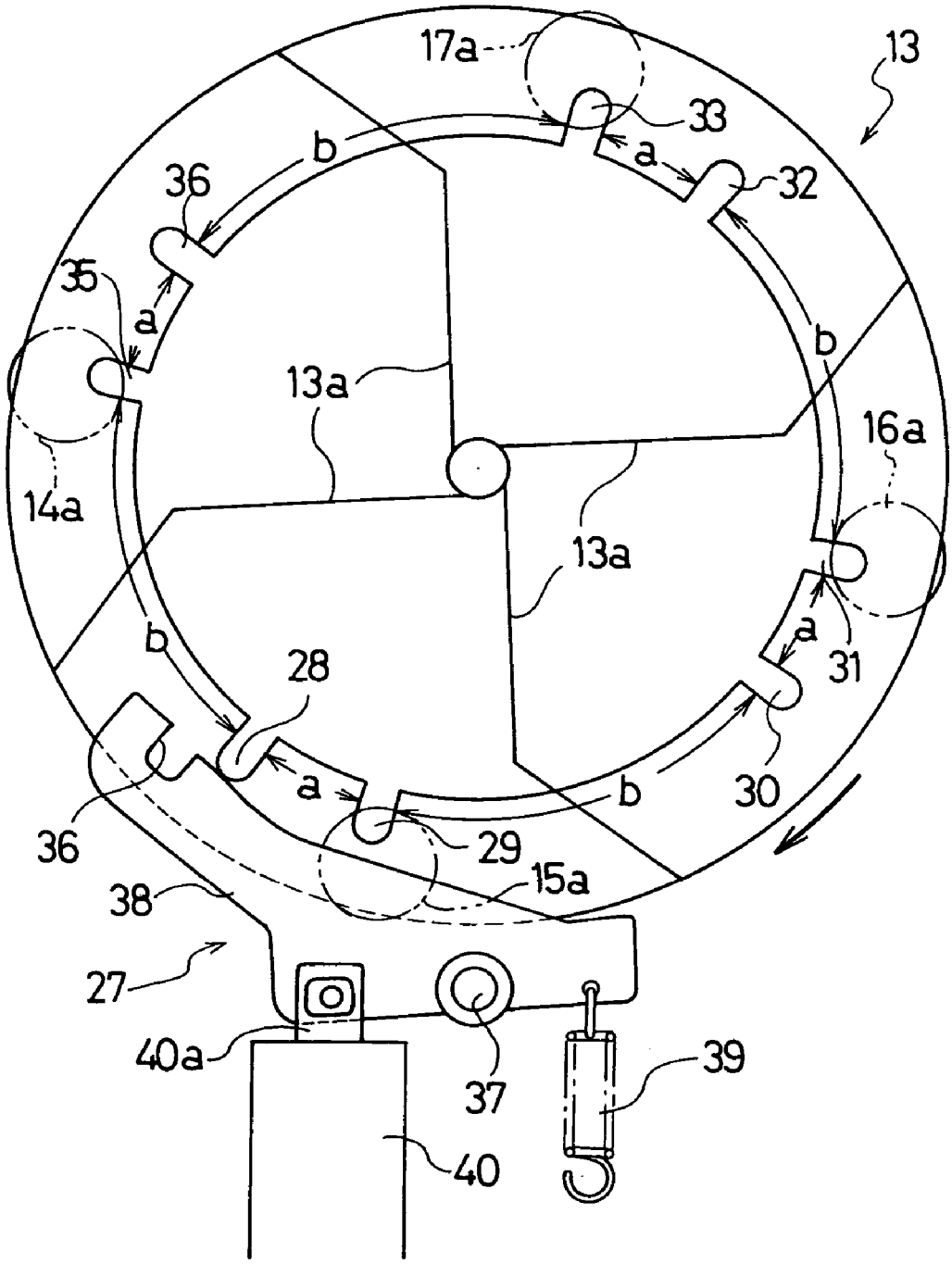
FIG. 19 is an illustration showing another scene in the operation of the locking means shown in FIG. 11 during the image forming operation.

As shown in FIG. 15, as the convexity 28 moves in the clockwise direction after the end of the convexity 28 collides with the start point 42*a* of the inclined face 42 of the lock lever 38, the end of the convexity 28 presses the inclined face 42 of the lock lever 38. Since the start point 42*a* is formed on an arc of the circle 44 of which center is equal to the rotation axis of the rotary 13, the convexity 28 can smoothly collide with the lock lever 38 and the end of the convexity 28 can smoothly move relative to the inclined face 42 as shown in FIG. 19. Accordingly, little disturbance produced when the end of the convexity 28 collides with the lock lever 38 is produced so that the rotary 13 is not affected by the collision and thus can smoothly continue to rotate. In addition, little noise due to the collision is generated. Moreover, the end of the convexity 28 is formed in an arc shape. Since the end of the convexity 28 comes in contact with the lock lever 38 at a point (exactly, along a line because of the thickness of the convexity 28 and the thickness of the lock lever 38), the contact friction is very small, thereby minimizing the effect on the rotary 13 due to the contact friction. Therefore, the rotation of the rotary 13 is further smooth.

As the end of the convexity 28 presses the inclined face 42, the lock lever 38 is rotated about the pivot 37 against the biasing force of the lock lever spring 39 in the counter clockwise direction in FIG. 19. As the rotational angle of the driving motor 21 becomes the target angle of 90 degrees, the CPU 51 stops the drive of the driving motor 21. However, the rotary 13 rotates in the clockwise direction because of its inertia. Since the offset load is small because the cartridges for four colors are mounted, the rotary 13 can overrun the stop position so that the rotational angle becomes (90+E') degrees. Therefore, as the rotary 13 further rotates in the clockwise direction in FIG. 19, the end of the convexity 28 is positioned to face the concavity 36. By the biasing force of the lock lever spring 39, the lock lever 38 pivots in the clockwise direction in FIG. 19 and comes in the locking position where the concavity 36 is engaged with the convexity 28. Just after that, the CPU 51 turns off the electromagnetic clutch 26 to isolate the rotor driving gear train. In this state, therefore, the driving force of the driving motor is not transmitted to the rotary driving gear 24.

Since the concavity 36 of the lock lever 38 is engaged with the convexity 28 and the driving force of the driving motor 21 is not transmitted, the lock lever 38 stops the rotary 13 and retains the rotary 13 at this position. That is, the rotary 13 is positioned by the lock lever 38. Since the lock lever 38 is switched from the standby position set near the locking position to the locking position, the lock lever 38 can rapidly lock the rotary 13 with small amount of pivotal movement and can ensure the locking of the rotary 13 because the concavity 36 is engaged with the convexity 28.

As a process of achieving the engagement between the concavity 36 of the lock lever 38 and the convexity 28, the concavity 36 moves along the arc of the end of the convexity 28 to engage the convexity 28. Therefore, there is no possibility of bounce of the lock lever 38 so that the concavity 36 is smoothly engaged with the convexity 28. In addition, since the corners of the concavity 36 are rounded, the concavity 36 is further smoothly engaged with the convexity 28.

In the state the rotary 13 is positioned by the engagement between the concavity 36 of the lock lever 38 and the convexity 28, the development cartridge 14 for yellow is set at the development position as shown in FIG. 1 and FIG. 8. That is, the development roller 14*a* is in contact with the photoreceptor 4. Then, the input gear 14*c* is meshed with the development cartridge driving gear 19, the CPU 51 drives the driving motor 21, and the one-way clutch is locked (connected) relative to the rotational direction of the driving motor 21 for the development operation. Therefore, the driving force of the driving motor 21 is inputted from the development cartridge driving gear 19 to the input gear 14*c* and is further transmitted to the development roller driving gear 14*b* with a reduction in speed by the power transmission gear mechanism 14*d*, whereby the development roller 14*a* is rotated.

Therefore, the development roller 14*a* carries a predetermined amount of yellow toner to the photoreceptor 4 so that the development for yellow of an electrostatic latent image on the photoreceptor 4 is performed, thereby forming an yellow toner image on the photoreceptor 4. During this development operation, a reaction force due to the development operation exerted on the lock lever 38 via the convexity 28 acts in a tangential direction of a circle of which center is equal to the rotation axis of the rotary 13 and which passes the center of the circular arc of the end of the convexity 28.

However, since the center of the pivot 37 as the rotation axis of the lock lever 38 is positioned on the tangent and the side wall 36*a* of the concavity 36 is formed on an arc of a circle of which center is the axis of the pivot 37, the reaction force due to the development operation never produces rotational force (rotational moment) of the lock lever 38. Therefore, there is no possibility of disengagement of the concavity 36 from the convexity 28 due to rotation of the lock lever 38 during the development operation, and the rotary 13 can be positioned securely by the lock lever 38 such that the development cartridge 14 is in the development position. In this case, since the side walls 36*a*, 36*b* of the concavity 36 are each formed to extend along an arc as a part of a circle of which center is equal to the axis of the pivot 37, the positioning of the rotary 13 is securely conducted regardless of which side wall 36*a* or 36*b* is subjected to the reaction force due to the development operation, and the positioning of the rotary 13 is securely conducted even when the development operation is suddenly stopped such as an irregular case.

By the way, in the operation for changing color, the driving motor 21 is controlled according the driving pattern shown in FIG. 16. This driving pattern is based on the assumption that the cartridges of four colors are mounted and that the offset load is small. However, for example, when the toner consumption of one of the cartridges for four colors is risen so that the amount of the toner in the cartridge is considerably less than those of the other cartridges or when one of the cartridges is not mounted, the offset load of the rotary 13 may be relatively increased. In such a case, the rotary 13 may not reach the stop position (rotational position at an angle of 90 degrees) in the range of the backlash of the driving gear train, that is, stops after rotating only (90–E') degrees.

In this case, however, since the driving gear train on the development side is engaged, the rotary 13 further rotates in its rotational direction due to the reaction force of the development operation at the start of the development operation conducted continuously after the stop of the driving motor 21 of the rotary 13, whereby the convexity 28 of the rotary 13 is engaged with the concavity 36 of the lock lever 38 and the rotary 13 is positioned at the development position for yellow (this positioning method of the rotary 13 in this case is the same as the positioning method disclosed in Japanese Patent Unexamined Publication No. 2002-311713).

The yellow toner image carried by the photoreceptor 4 is primarily transferred to the intermediate transfer medium 5 by the primary transfer device 6. As the primary transfer of the yellow toner image is finished, the CPU 51 stops the driving motor 21 and, at the same time, turns on and connects the electromagnetic clutch 26 again. At this point, the operation of the development cartridge 14 is stopped. Just after that, the CPU 51 excites the solenoid 40 so that the plunger 40*a* is pulled by the solenoid force of the solenoid 40, whereby the lock lever 38 is rotated about the pivot 37 in the counter clockwise direction in FIG. 20 against the biasing force of the lock lever spring 39. Then, the concavity 36 is disengaged from the convexity 28, that is, the engagement between the concavity 36 and the convexity 28 is released, so that the lock lever 38 is in the evacuation position where the concavity 36 and the convexity 28 are not engaged with each other. After that, the CPU 51 drives the driving motor 21 so that the rotary 13 is rotated again in the clockwise direction in FIG. 21 by the driving force of the driving motor 21 in the same manner as described above.

At about the time starting the rotation of the rotary 13, the exposure device 2 exposes the photoreceptor 4 to light based on the image signal for magenta from the CPU 51, thereby forming an electrostatic latent image for magenta on the photoreceptor 4.

Figure 22:
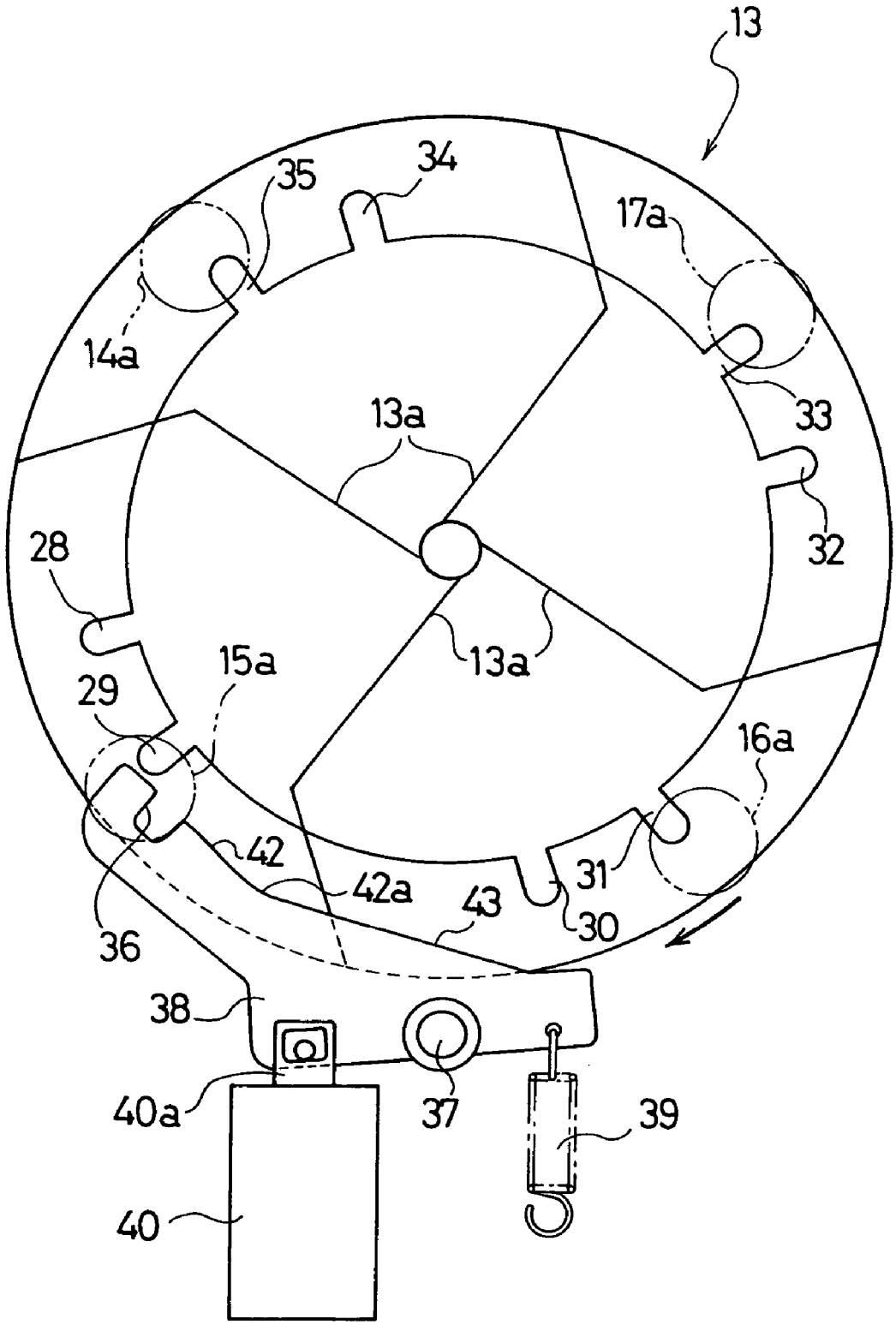
FIG. 22 is an illustration showing yet another scene in the operation of the locking means shown in FIG. 11 during the image forming operation.

According to the rotation of the rotary 13, the positioning convexity 29 for replacement passes the concavity 36 as shown in FIG. 22. As the convexity 29 deviates from the region of the lock lever 38 according to the further rotation of the rotary 13, the excitation of the solenoid 40 is cancelled so that the plunger 40*a* is released from the solenoid force. Then, the lock lever 38 is rotated about the pivot 37 in the clockwise direction in FIG. 22 by the biasing force of the lock lever spring 39 so that the lock lever 38 comes in contact with the stopper 41 and becomes in the standby position again similarly to the state shown in FIG. 11.

The rotary 13 is rotated at a relatively high speed for the image forming operation as mentioned above. Since the interval "a" in the circumferential direction between the positioning convexity 28 for development and the positioning convexity 29 for replacement is set to be smaller than the interval "b" in the circumferential direction between the convexity 29 and the positioning convexity 30 for development of the next development cartridge 15 for magenta, enough period of time can be ensured until the convexity 30 reaches the position where the convexity 30 comes in contact with the start point 42*a* of the inclined face 42 of the lock lever 38. That is, a long period of time of releasing the plunger 40*a* can be estimated. Therefore, even if the time from the restrained state where the solenoid 40 is excited and the plunger 40*a* is pulled by the solenoid force to the released state is uncertain and long, the lock lever 38 can be securely set at the standby position before the convexity 30 reaches the position where it comes in contact with the start point 42*a*.

For setting the time for releasing the plunger 40*a* of the solenoid as longer as possible, it is preferable that the interval "a" is set to be the minimum value possible in a range allowing the engagement of the concavity 36 of the lock lever 38 with the positioning convexity 29; 31; 33; 35 for replacement and the interval "b" is therefore set to be large.

Figure 20:
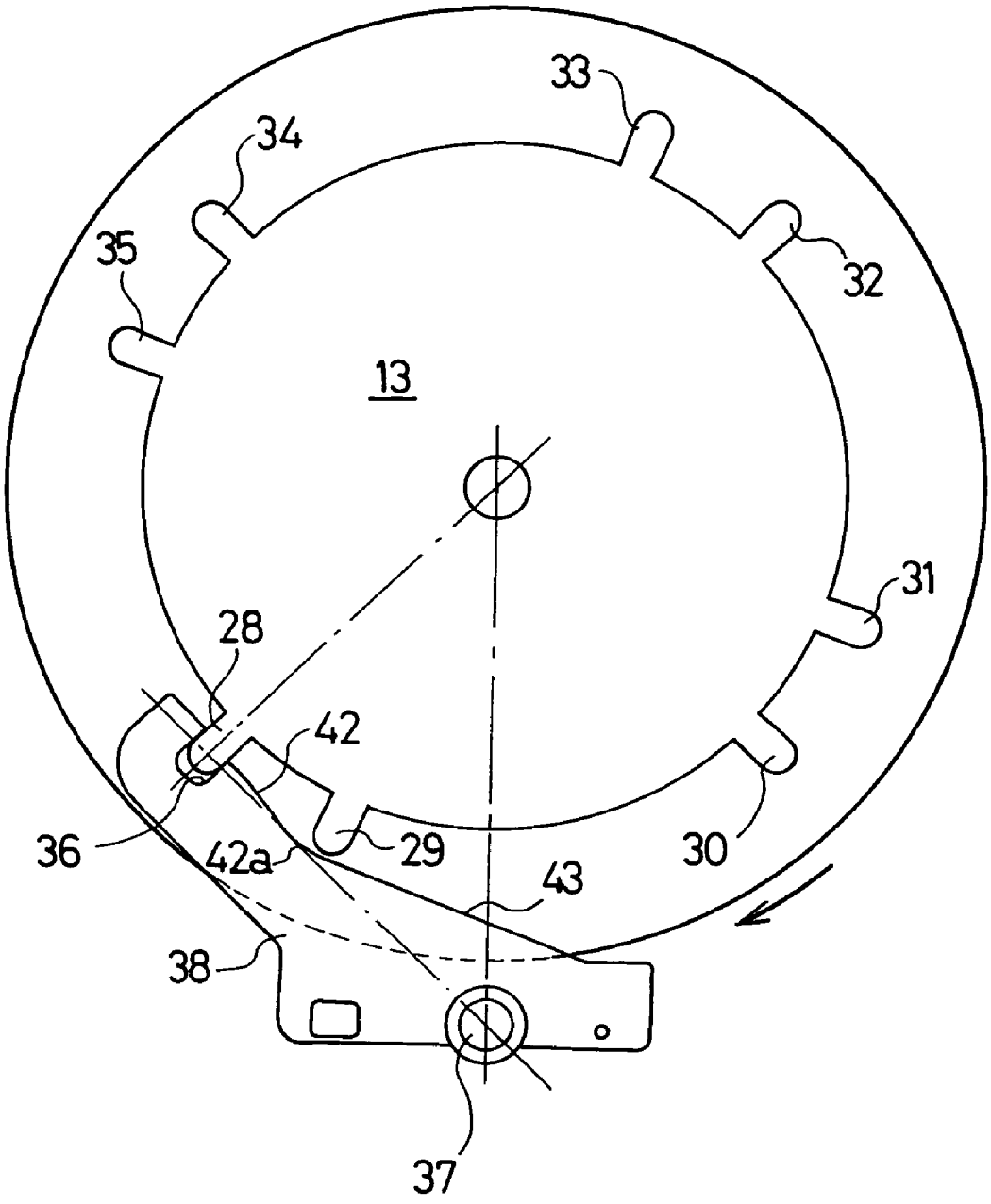
FIG. 20 is an illustration showing still another scene in the operation of the locking means shown in FIG. 11 during the image forming operation.

As the rotary 13 is further rotated in the clockwise direction in FIG. 11, similarly to the aforementioned case for yellow as shown in FIG. 20, the concavity 36 of the lock lever 38 is engaged with the positioning convexity 30 for development so that the rotary 13 is positioned and the development cartridge 15 for magenta is set at the development position.

As the development cartridge 15 for magenta is set at the development position, the rotary 13 is stopped from rotating and is retained at the position, the input gear 15*c* is meshed with the development cartridge driving gear 19, and the development roller 15*a* comes in contact with the photoreceptor 4. Then, the development for magenta is conducted by the development cartridge 15 for magenta and a magenta toner image developed on the photoreceptor 4 is primarily transferred to the intermediate transfer medium 5.

As the primary transfer of the magenta toner image is finished, the CPU 51 stops the driving motor 21 and, at the same time, turns on and connects the electromagnetic clutch 26 again similarly to the aforementioned case for yellow. At this point, the driving of the development cartridge 15 is stopped. Just after that, the solenoid 40 is excited so that the concavity 36 is disengaged from the positioning convexity 30 for development and the rotary 13 is rotated in the same direction.

Further, similarly to the aforementioned case for yellow, the cancellation of excitement of the solenoid 40 sets the lock lever 38 to the standby position in the same manner as shown in FIG. 11. After that, in the same manner, the concavity 36 of the lock lever 38 is engaged with the positioning convexity 32 for development of the development cartridge 16 for cyan, whereby the development for cyan is conducted by the development cartridge 16 for cyan and a cyan toner image developed on the photoreceptor 4 is primarily transferred to the intermediate transfer medium 5. Further, the concavity 36 of the lock lever 38 is engaged with the positioning convexity 34 for development of the development cartridge 17 for black, whereby the development for black is conducted by the development cartridge 17 for black and a black toner image developed on the photoreceptor 4 is primarily transferred to the intermediate transfer medium 5.

Accordingly, toner images of four colors primarily transferred on the intermediate transfer medium 5 are toned so as to form a full-color toner image. The full-color toner image on the intermediate transfer medium 5 is transferred to a paper sheet 7 by the secondary transfer device 8. Then, the toner image transferred to the paper sheet 7 is fused by the fixing unit, thereby forming a full-color image on the paper sheet 7.

Figure 21:
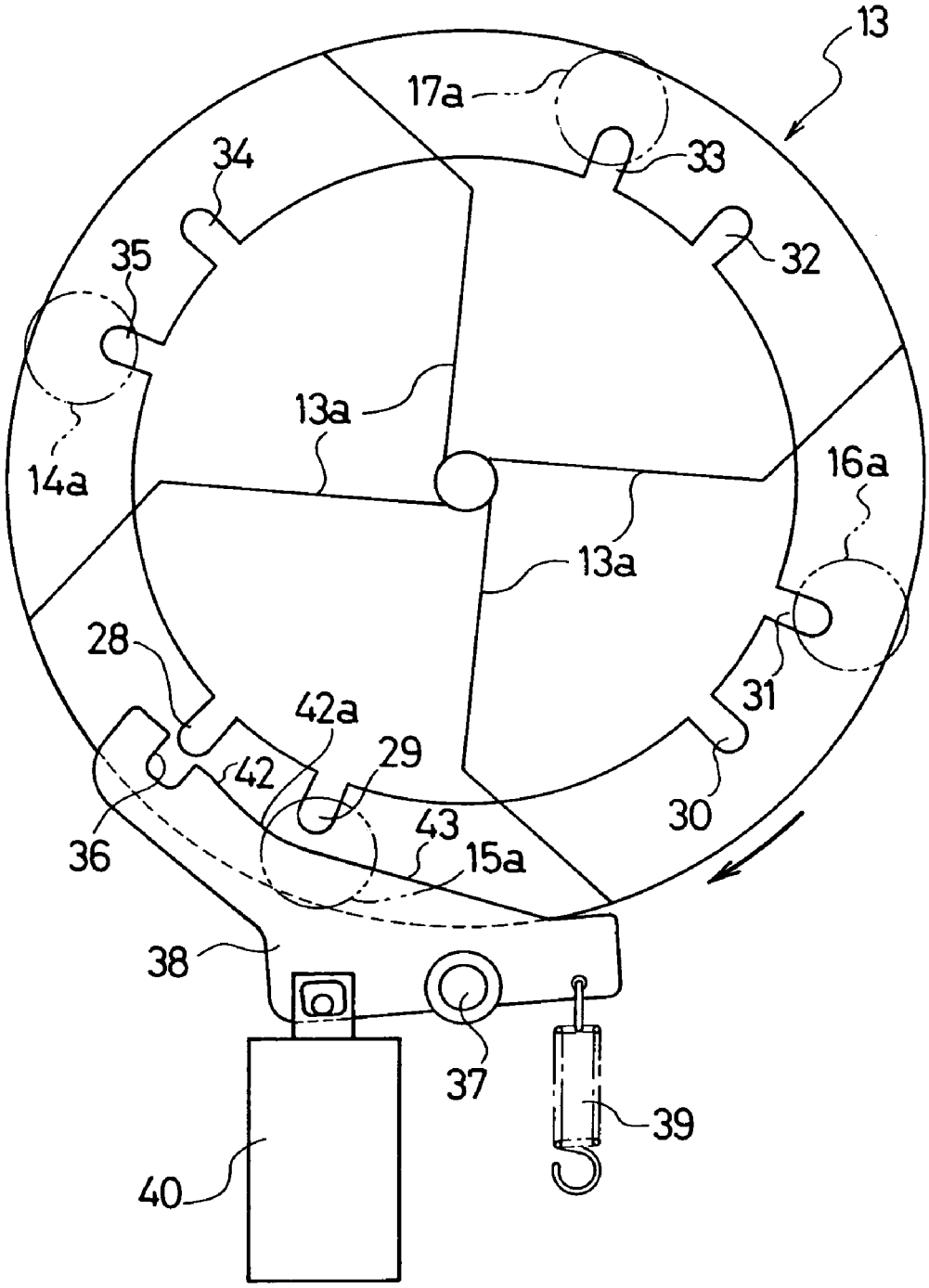
FIG. 21 is an illustration showing further another scene in the operation of the locking means shown in FIG. 11 during the image forming operation.

Hereinafter, description will now be made as regard to the operation for replacing any of the development cartridges 14, 15, 16, 17. For example, as a user runs a key for the replacement of the development cartridge on the operation panel of the image forming apparatus 1, the CPU 51 drives the driving motor 21, turns on the electromagnetic clutch 26, and excites the solenoid 40. Then, similarly to the case as shown in FIG. 21 and FIG. 22, the lock lever 38 is retained by the solenoid 40 at a position where the concavity 36 is not engaged with the convexity and the rotary 13 is rotated in the clockwise direction in FIG. 21 and FIG. 22. During the operation for replacing the development cartridge, the rotary is rotated at a relatively lower speed than that for the image forming operation.

Just before the development cartridge to be replaced, for example, the development cartridge 14 for yellow reaches the replacement position, that is, just before the positioning convexity 29 for replacement corresponding to the development cartridge 14 reaches the position where it engages the concavity 36 of the lock lever 38, the CPU 51 cancel the excitement of the solenoid 40. Then, in the same manner as described above, the lock lever 38 is rotated about the pivot 37 in the clockwise direction, i.e. the direction toward the standby position, by the biasing force of the lock lever spring 39 so that the positioning convexity 29 for replacement of the development cartridge 14 comes in contact with the inclined face 42 of the lock lever 38. According to further rotation of the rotary 13, as the positioning convexity 29 presses the inclined face 42, the lock lever 38 is rotated about the pivot 37 in the counter clockwise direction in the same manner as mentioned above.

Since the driving pattern of the driving motor 21 for the operation for replacing the development cartridge is set based on the assumption that the maximum offset load is exerted in the reverse rotational direction of the rotary 13, this state meeting a condition making it difficult for the rotary to overrun, the rotary 13 overruns the stop position without fail.

Figure 23:
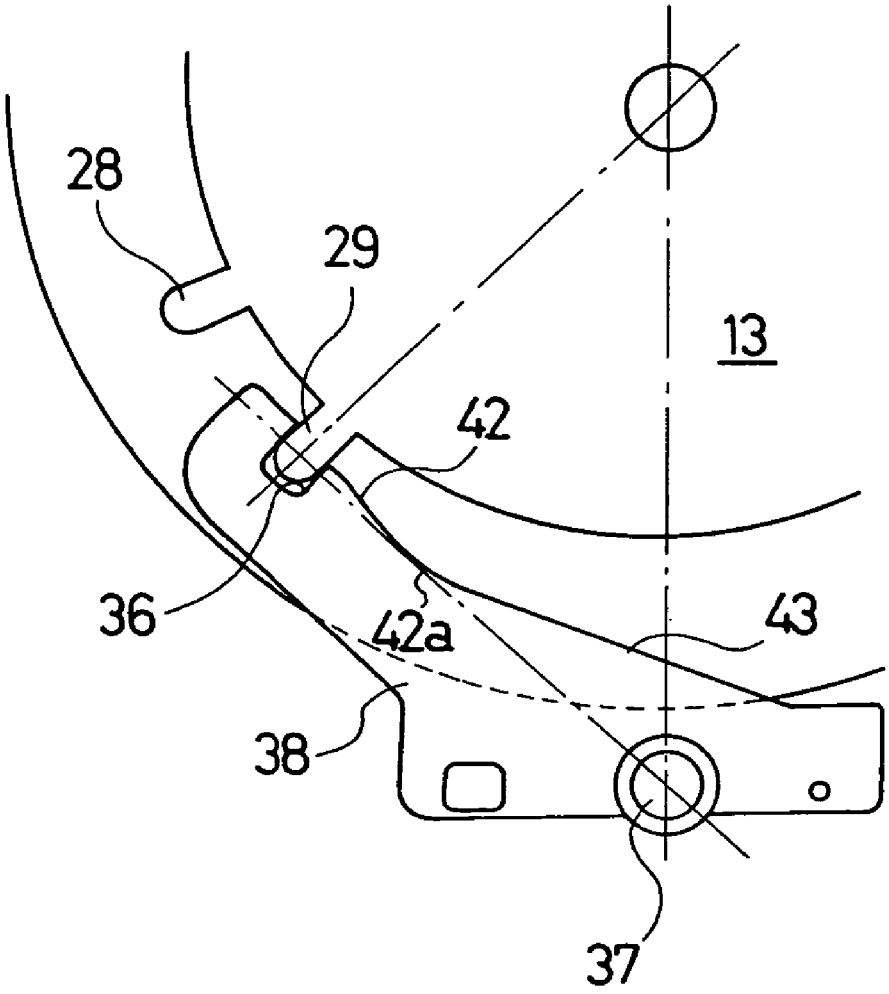
FIG. 23 is an illustration showing the state where the rotary is positioned by the locking means shown in FIG. 11 during the operation of replacing development cartridge.

Therefore, as the positioning convexity 29 for replacement reaches the position corresponding to the concavity 36, the lock lever 38 is rotated about the pivot 37 in the clockwise direction by the biasing force of the lock lever spring 39 so that the concavity 36 is engaged with the convexity 29 as shown in FIG. 23 in the same manner as mentioned above. Accordingly, the rotary 13 is stopped from rotating and is retained at the position. Though the excitation of the solenoid 40 is cancelled just before the positioning convexity 29 for replacement reaches the position where it engages the concavity 36, the rotary 13 is rotated at a relatively lower speed during the replacement operation so that the concavity 36 is securely engaged with the convexity 29 even if the time from the restrained state where the plunger 40*a* of the solenoid 40 is pulled by the solenoid force to the released state is uncertain and long.

In this manner, in the state that the rotary 13 is positioned, the development cartridge 14 to be replaced is set at the replacement position. When the development cartridge 14 is set at the replacement position, the development roller 14*a* of the development cartridge 14 is spaced apart from the photoreceptor 4 and the input gear 14*c* is spaced apart from the development cartridge driving gear 19.

In the state that the development cartridge 14 to be replaced is set at the replacement position, the development cartridge 14 is removed by withdrawing the development cartridge 14 from the rotary 13 through the development cartridge replacement opening 45 in the axial direction of the rotary 13 and a new development cartridge is installed by inserting the new development cartridge into the rotary 13 through the development cartridge replacement opening 45 in the axial direction of the rotary 13. Since the development roller of the development cartridge to be replaced is spaced apart from the photoreceptor 4 during the replacement of the development cartridge, the photoreceptor 4 may not be damaged by the development cartridge during the replacement operation.

In the image forming apparatus 1 of the second embodiment, the convexity comes in contact with the inclined face 42 of the lock lever 38 before the concavity of the lock lever 38 is engaged with the convexity formed on the rotary 13 according to the rotation of the rotary 13. Therefore, the lock lever 38 is moved according to the rotation of the rotary 13 so that the engagement between the concavity 36 of the lock lever 38 and the convexity of the rotary 13 is completed simultaneously with the arrival of the rotary 13 at the predetermined position. That is, the start of the development operation is allowed immediately after the rotary is stopped at the development position, thereby shortening the time required for obtaining toner images of four colors by changing color and, as a result, improving the speed of forming a full-color image.

Since the solenoid 40 is employed as the means for evacuating the lock lever 38, the lock lever 38 is reliably and quickly operated.

During the rotation of the rotary 13, the lock lever 38 is previously set at the standby position before the stop of the rotary 13. From this state, the rotary 13 is restrained and positioned by operating the lock lever 38 simultaneously with the stop of the rotary 13. Therefore, the moving amount of the lock lever 38 from the standby position to the position restraining the rotary 13 is small. This shortens the time required for obtaining toner images of four colors by changing color and, as a result, improving the speed of forming a full-color image.

Since the convexity formed on the rotary 13 side is designed to come in contact with the inclined face 42 of the lock lever 38, little disturbance produced when the end of the convexity 28 collides with the lock lever 38 is produced so that the rotary 13 is not affected by the collision and thus can smoothly rotate. In addition, little noise due to the collision is generated.

Particularly, the start point 42*a* of the inclined face 42 is formed on an arc of a circle of which center is equal to the rotation axis of the rotary 13 and which passes the ends of the convexities, the end of the convexity can smoothly move when the contact portion of the end of the convexity with the lock lever 38 transfers from the linear portion 43 to the inclined face 42 of the lock lever 38.

Moreover, since the end of the convexity is formed in an arc shape and is designed such that the end of the convexity comes in contact with the lock lever 38 at a point (or along a line), the contact friction is very small, thereby reducing the effect on the rotary 13 due to the contact friction. Therefore, the rotation of the rotary 13 is further smooth.

In addition, as a process of achieving the engagement between the concavity 36 of the lock lever 38 and the convexity 28, the concavity 36 moves along the arc of the end of the convexity 28 to engage the convexity 28. Therefore, there is no possibility of bounce of the lock lever 38 so that the concavity 36 can be reliably engaged with the convexity 28 and the rotary can be reliably restrained at the stop position.

During this development operation, a reaction force due to the development operation exerted on the lock lever 38 via the convexity acts in a tangential direction of a circle of which center is equal to the rotation axis of the rotary 13 and which passes the center of the circular arc of the end of the convexity. Since the rotational axis of the lock lever 38 is positioned on the tangent and the side wall 36*a* of the concavity 36 is formed on an arc of a circle of which center is the axis of the pivot 37, the reaction force due to the development operation never produces rotational force (rotational moment) of the lock lever 38. Therefore, there is no possibility of disengagement of the concavity 36 from the convexity 28 due to rotation of the lock lever 38 during the development operation, and the rotary 13 can be positioned securely by the lock lever 38.

In this case, since the side walls 36*a*, 36*b* of the concavity 36 are each formed to extend along an arc as a part of a circle of which center is equal to the rotational axis of the lock lever 38, the positioning of the rotary 13 is securely conducted regardless of which side wall 36*a* or 36*b* is subjected to the reaction force due to the development operation, and the positioning of the rotary 13 is securely conducted even when the development operation is suddenly stopped such as an irregular case.

Further, the positioning convexities 28, 30, 32, 34 for development and the positioning convexities 29, 31, 33, 35 for replacement are provided to corresponding to the development cartridges 14, 15, 16, 17, respectively, and the intervals "a" between each pair of the positioning convexities 28, 30, 32, 34 for development and the positioning convexities 29, 31, 33, 35 for replacement is set to be smaller than the interval "b" in the circumferential direction between the positioning convexity 29, 31, 33, 35 for replacement and the positioning convexity 30, 32, 34, 28 for development of the next development cartridge 15, 16, 17, 14, enough period of time can be ensured until the convexity reaches the position where it comes in contact with the start point 42*a* of the inclined face 42 of the lock lever 38. That is, a long period of time of releasing the plunger 40*a* can be estimated. Therefore, even if the time from the restrained state where the plunger 40*a* is pulled by the solenoid force of the solenoid 40 to the released state is uncertain and long as mentioned above, the lock lever 38 can be securely set at the standby position before the convexity reaches the position where it comes in contact with the start point 42*a*.

When the rotary 13 tends to rotate (90+E') degrees beyond (overrun) the stop position (the 90-degree rotation position) within a range of backlash or when the rotary 13 stops after rotating only (90−E') degrees within the range of backlash, i.e. stops before reaching the stop position during the operation of changing color, the final stopping rotation angle becomes always 90 degrees, achieving the high-precision positioning. In addition, since the high-precision positioning is achieved, the start angle falls in exactly the same phase relative to the next rotation of the rotary. Therefore, even if there is difference in rotational angle due to the backlash of the rotary drive gear train as mentioned above, the difference can be always cancelled, thereby ensuring the stable rotation of the rotary 13.

Figure 24:
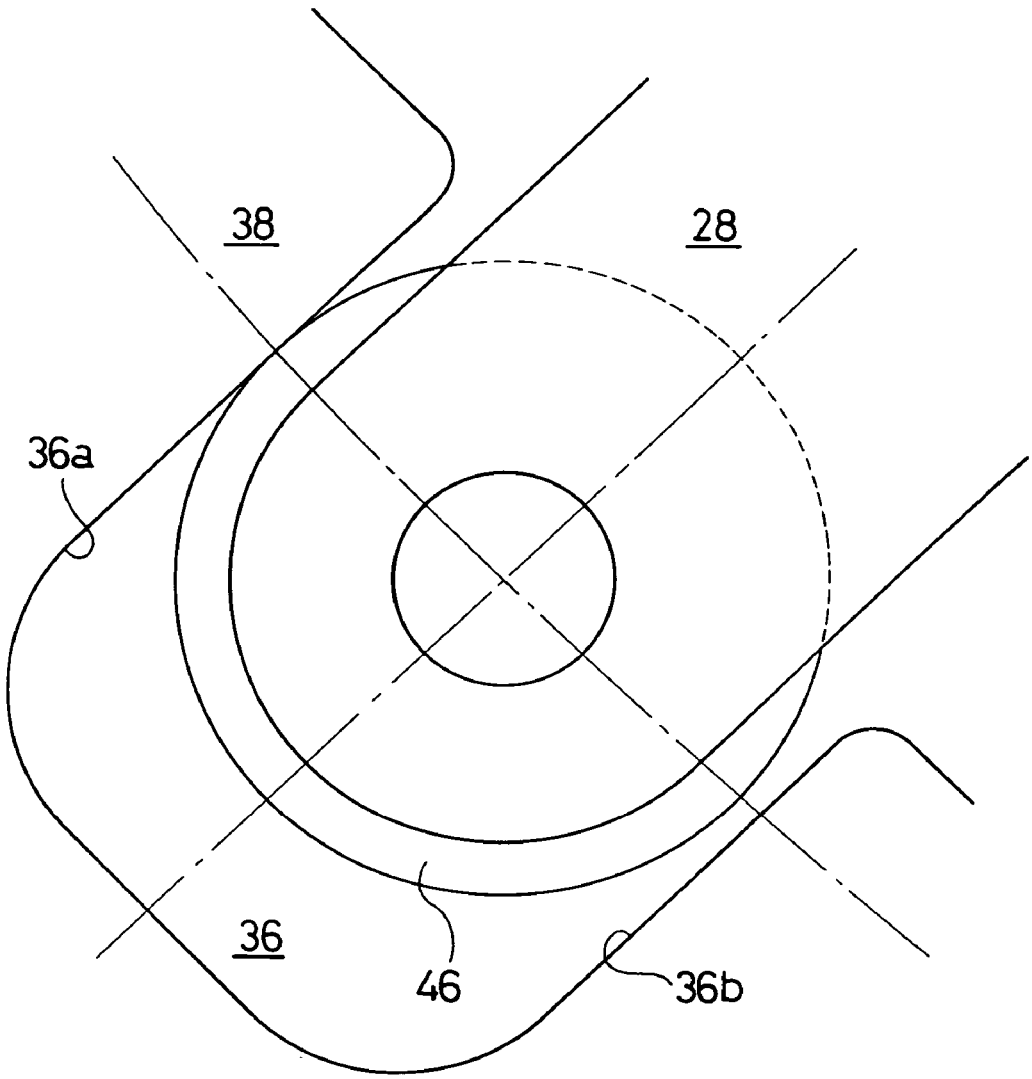
FIG. 24 is a partially enlarged view similar to FIG. 14, but showing an image forming apparatus of the third embodiment of the present invention.

FIG. 24 is a partially enlarged view similar to FIG. 14, but showing a third embodiment of the image forming apparatus of the present invention. It should be noted that the same components as those of the aforementioned embodiments are marked with the same numerals, so description of such components will be omitted.

Though the ends of the convexities 28, 29, 30, 31, 32, 33, 34, 35 are each formed in an arc shape in the second embodiment, each of convexities 28, 29, 30, 31, 32, 33, 34, 35 is provided at its end with a rotary 46 such as a rotatable roller rotatably disposed in the image forming apparatus 1 of the third embodiment. In this case, the rotational axis of the rotary 46 is set at the same position as the center of the arc of the end of the convexity.

According to the image forming apparatus 1 of the third embodiment, the convexity comes in contact with the lock lever 38 via the rotary 46, thereby significantly reducing the friction due to the contact. Therefore, the effect on the rotary 13 due to the contact friction is further reduced and the disengagement of the convexity from the concavity of the lock lever 38 is extremely facilitated. In addition, at least the surface of the rotary 46 is composed of an elastic member having such elasticity capable of keeping the function of positioning the rotary 13, thereby exhibiting buffering effect when the lock lever 38 is engaged with the convexity and when the lock lever 38 is disengaged from the convexity.

Other structure and other works and effects of the image forming apparatus of the third embodiment are the same as those of the aforementioned second embodiment.

Though four development cartridges 14, 15, 16, 17 are mounted to the rotary 13 in the first through third embodiments, the number of development cartridges is not limited to four and a plurality of development cartridges may be mounted in the image forming apparatus of the present invention.

Though a single driving motor 21 is commonly provided for driving the rotary and for driving the development cartridge in the aforementioned second and third embodiments, driving motors may be separately provided for driving the rotary and for driving the development cartridge, respectively, similarly to the first embodiment.

Though the transmission and isolation of the driving force of the driving motor to the rotary 13 is controlled by the electromagnetic clutch 26 as the power transmission control means in the aforementioned second and third embodiments, the transmission and isolation of the driving force of the driving motor to the development cartridge may be controlled by the electromagnetic clutch, and both the transmission and isolation of the driving force of the driving motor to the development cartridge and the transmission and isolation of the driving force of the driving motor to the rotary 13 may be controlled by the electromagnetic clutches.

Though the driving pattern during the operation of changing color shown in FIG. 16 is based on the assumption that the cartridges of four colors are mounted and that the offset load is small in the aforementioned second and third embodiments, the driving pattern may be based on the assumption that the maximum offset load is exerted in the reverse rotational direction of the rotary 13, this state meeting a condition making it difficult for the rotary to overrun, at the stop of the driving motor 21. In this case, the rotary 13 inevitably overruns the stop position to securely engage the convexity of the rotary 13 with the concavity 36 of the lock lever even for the operation of changing color. Therefore, the rotary 13 can be reliably set at the stop position (that is, the development position).

We claim:

1. An image forming apparatus comprising at least:

a rotary, a rotary driving motor for rotating the rotary, a plurality of development units each of which is mounted to said rotary such that the development unit is replaceable at a replacement position and has a development roller for carrying developer-and an input gear, a development unit driving motor for driving said development roller, a development unit driving gear which is disposed outside said rotary such that the development unit driving gear can be selectively meshed with said input gear of one of said plurality of development units and to which the driving force of said development unit driving motor is transmitted, and a control device for controlling the drive of said rotary driving motor and said development unit driving motor, wherein:

during the image forming operation, said development rollers of the respective development units are set at the development position relative to a photoreceptor by turns according to the rotation of said rotary and, at the development position, said input gear of each of the respective plurality of development units are meshed with said development unit driving gear so as to drive said development rollers with the driving force of said development unit driving motor by turns, thereby achieving multi-color development, said image forming apparatus further comprising a rotary driving motor control means which controls said rotary driving motor for the rotation of said rotary during the non-image forming operation such that the rotational speed of said rotary in a contact region where said input gear collides with said development unit driving gear is lower than the rotational speed of said rotary in a region other than said contact region, and the rotational speed of-said rotary in the region other than said contact region during the rotation of said rotary in the non-image forming operation is set to be lower than the maximum speed of said rotary rotating during the image forming operation.

2. An image forming apparatus as claimed in claim 1, wherein an impact absorbing means for absorbing an impact generated when said input gear collides with said development unit driving gear during the rotation of said rotary in the non-image forming operation is provided on said development unit driving gear side.

3. An image forming apparatus as claimed in claim 1, wherein the rotational speed of said rotary in the region other than said contact region during the rotation of said rotary in the non-image forming operation is set to a first speed corresponding to the rotational speed of the maximum torque (Tmax) of said development unit driving motor and the speed of said rotary when any one of the input gears passes said contact region during the rotation of said rotary in the non-image forming operation is set to a second speed lower than said first speed.

4. An image forming apparatus as claimed in claim 1, wherein the rotation of said rotary during said non-image forming operation is at least one of a group consisting of the rotation of said rotary for setting the development unit to be replaced at said replacement position during the operation of replacing said development unit, the rotation of said rotary for resetting and initializing the phase of said rotary after power-on, the rotation of said rotary for initializing the phase of said rotary after sudden power-down, and the rotation of said rotary for moving to the home position after the final development procedure.

5. An image forming apparatus comprising:

a developing device of a rotary development type having a rotary on which a plurality of development units are mounted, and a locking means for positioning said rotary in order to selectively set said development units at a predetermined position and for locking the rotary at the predetermined position, wherein:

said locking means comprises a lockable position formed on said rotary side, a locking member which is movably disposed on the body of the image forming apparatus and has a locking position where the locking member is engaged with said lockable position to lock said rotary and an evacuation position where the locking member is not engaged with said lockable position, a shifting means for shifting said locking:member to said evacuation position, and a biasing means for biasing said locking member to said locking position, said locking member has a contact portion which can come in contact with said lockable position before the engagement with said lockable position according to the rotation of said rotary, said lockable position is composed of convexities formed on the rotary, said locking member is a lock lever which is movably disposed to the body of said image forming apparatus, and said lock lever has a concavity engageable with one of said convexities and has a contact portion with which the convexity comes in contact before engaging said concavity according to the rotation of said rotary, and side walls of said concavity are each formed in an arc of a circle of which center is equal to the rotational axis of said lock lever.

6. An image forming apparatus as claimed in claim 5, wherein:

said convexities are disposed corresponding to said development units, respectively, that said convexities are positioning convexities for development for positioning said rotary at said development position and positioning convexities for replacement for positioning said rotary at said replacement position, and said lock lever has a concavity which can be selectively engaged with one of said convexities and has a contact portion with which the convexity comes in contact before engaging said concavity according to the rotation of said rotary.

7. An image forming apparatus as claimed in claim 6, wherein the interval in the circumferential direction between said positioning convexity for development and said positioning convexity for replacement for one development unit is set to be smaller than the interval in the circumferential direction between said positioning convexity for replacement for said one development unit and the positioning convexity for development for the next development unit.

8. An image forming apparatus as claimed in claim 5, wherein:

the end of said each convexity is formed in an arc shape, said contact portion is an inclined face with which the arc-shape end of said convexity can come in contact, and the start point of said inclined face is formed on an arc of a circle of which center is equal to the rotational axis of said rotary and which passes the ends of said convexities, and that, according to the rotation of said rotary, said convexity comes in contact with said inclined face and presses said inclined face before said convexity is engaged with said concavity.

* * * * *